US006655402B1

(12) United States Patent
Fan

(10) Patent No.: US 6,655,402 B1
(45) Date of Patent: Dec. 2, 2003

(54) SYSTEM AND METHOD FOR VACUUM FLUSHING SEWER SOLIDS

(75) Inventor: Chi-Yuan Fan, Edison, NJ (US)

(73) Assignee: U.S. Environmental Protection Agency, Washington, DC (US)

( * ) Notice: Subject to any disclaimer, the term of this patent is extended or adjusted under 35 U.S.C. 154(b) by 0 days.

(21) Appl. No.: 10/171,441

(22) Filed: Jun. 13, 2002

(51) Int. Cl.[7] ..... E03C 1/12; F16K 15/00
(52) U.S. Cl. ..... 137/1; 137/236.1; 137/526
(58) Field of Search ..... 137/236.1, 511, 137/1, 526

(56) References Cited

U.S. PATENT DOCUMENTS 5,588,458 A * 12/1996 Ushitora et al. ..... 137/236.1 X
5,673,723 A * 10/1997 Roediger ..... 137/236.1 X
5,871,027 A * 2/1999 Shimizu et al. ..... 137/205
6,234,198 B1 * 5/2001 Chalich ..... 137/526
6,383,370 B1 * 5/2002 Keever et al. ..... 210/96.1
6,415,816 B1 * 7/2002 Beckey et al. ..... 137/526

* cited by examiner

*Primary Examiner*—Kevin Lee
(74) *Attorney, Agent, or Firm*—Janine R. Novatt; Weiss, Moy & Harris, P.C.

(57) ABSTRACT

A flushing system and method are provided for substantially reducing sewer solid accumulation in urban drainage systems such that their performance is optimized, their structural integrity is substantially maintained, and pollution of receiving waters is substantially minimized. The flushing system includes at least one flush reservoir that fluidly communicates with the urban drainage system and discharges wet weather flow to flush accumulated sewer solids therefrom. An air release valve on the at least one flush reservoir closes when it is substantially full to create a vacuum that is broken by drawing air through an air intake conduit in the at least one flush reservoir when the urban drainage system is drained to a predetermined level.

21 Claims, 20 Drawing Sheets

FIG. 9
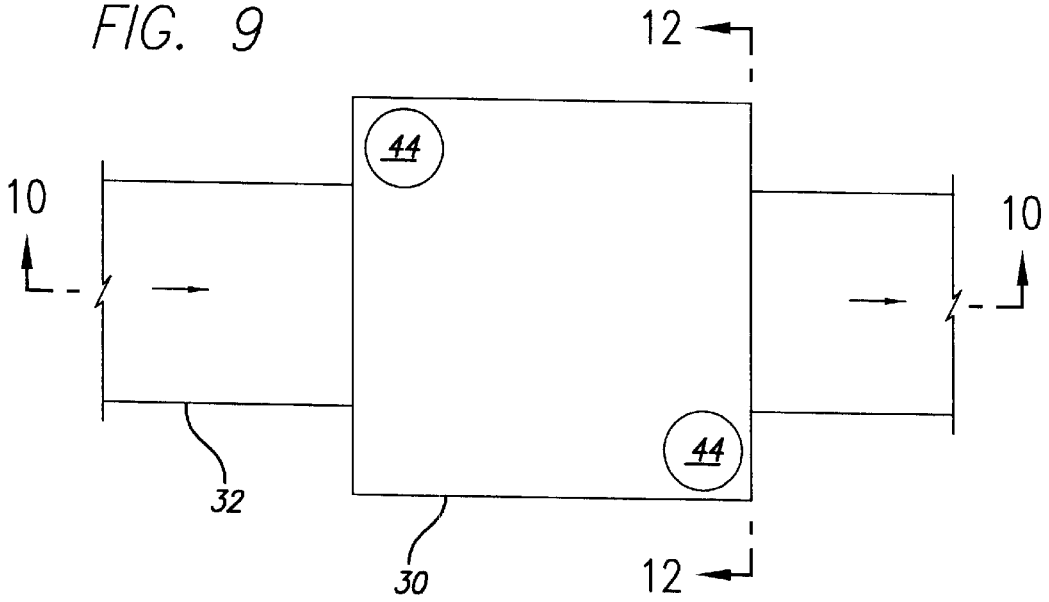
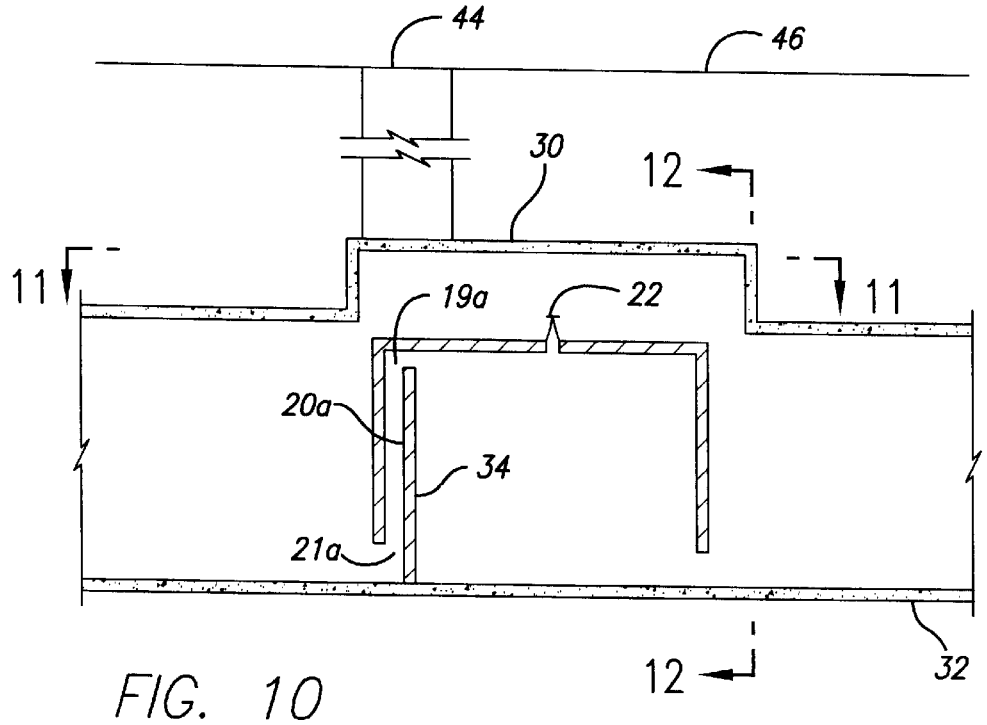
FIG. 10

FIG. 11
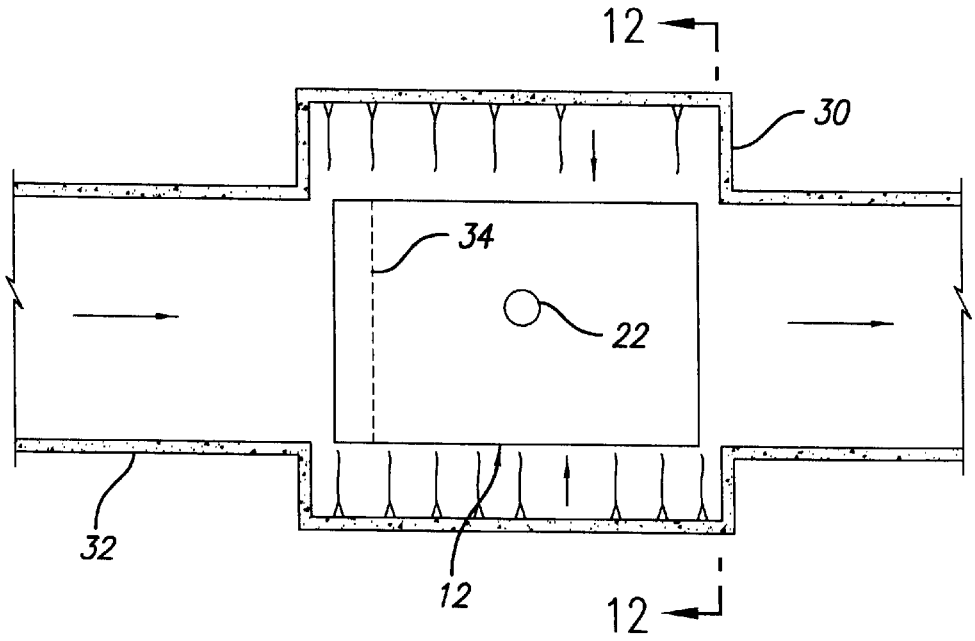
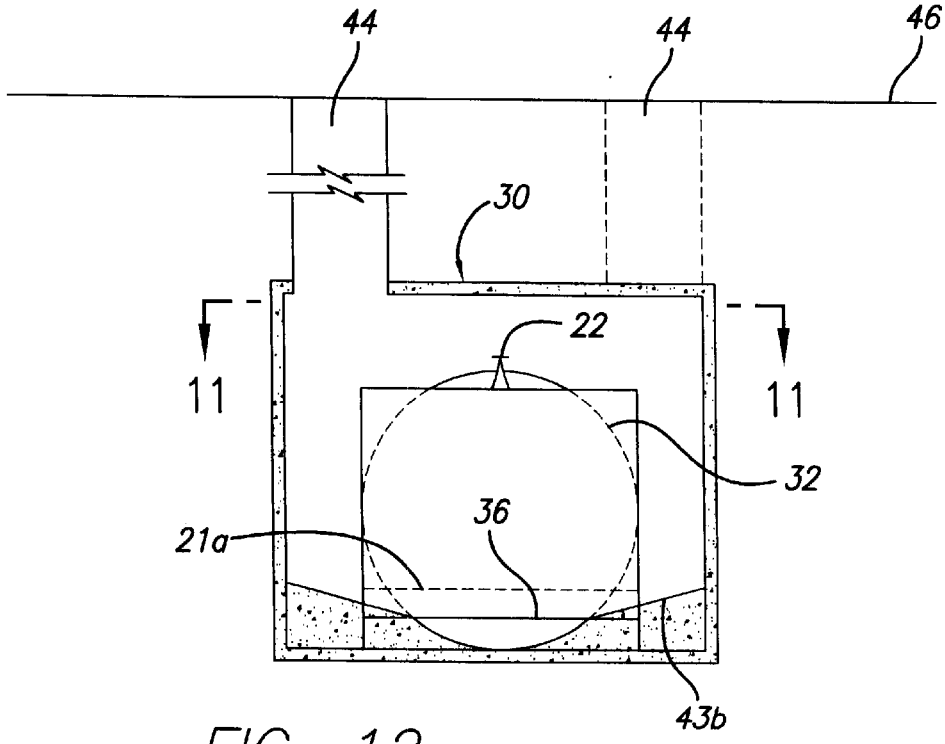
FIG. 12

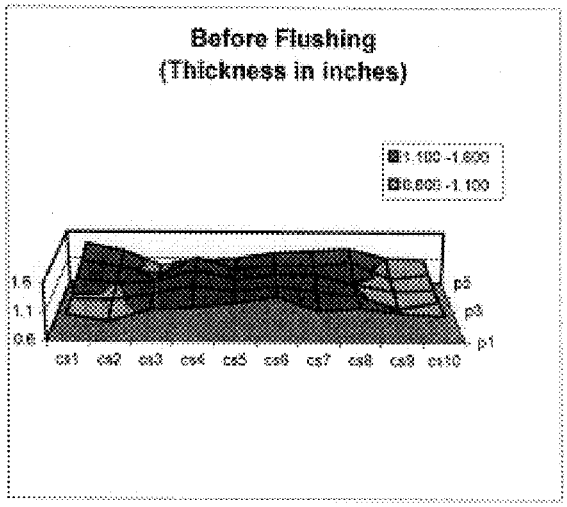
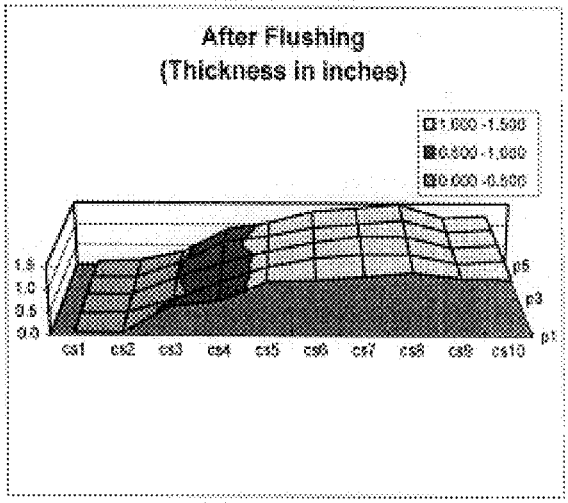
Cs1: Cross-Section 1
P1: Point 1
FIG. 23

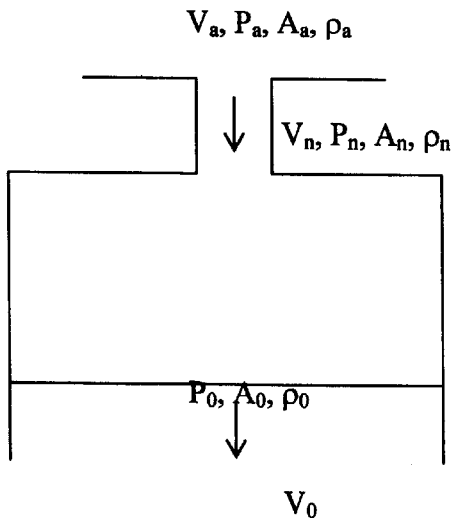

FIG. 31

Known parameters are:

$V_a$ = Air flow velocity outside the tank, very small, assumed to be zero;

$P_a$ = Pressure of air outside the tank, equal to atmospheric pressure;

$A_a$ = Cross sectional area of air flow outside the tank, very large, assumed to be infinity;

$\rho_a$ = Density of air outside the tank;

$A_n$ = Cross sectional area of air intake, designed;

$A_0$ = Cross sectional area of flushing tank, designed;

$V_0$ = Water downward flow velocity in flushing tank, calculated from the above hydrodynamic model.

Unknown parameters are:

$V_n$ = Velocity of air flow through the intake;

$P_n$ = Pressure of air pressure through the intake;

$\rho_n$ = Density of air flow through the intake;

$P_0$ = Pressure of air flow inside the flushing tank;

$\rho_0$ = Density of air flow inside the flushing tank;

SYSTEM AND METHOD FOR VACUUM FLUSHING SEWER SOLIDS

FIELD OF THE INVENTION

This invention relates generally to water quality management and more particularly to a system and method for substantially preventing sewer solid accumulation in an urban drainage system.

BACKGROUND OF THE INVENTION

Most urban drainage systems have evolved into a complex network that includes combined sewer systems (including interceptor sewers), separated sanitary sewer systems, stormwater sewer systems, channels, and culverts. This network conveys domestic and industrial wastewater to wastewater treatment plants during dry weather (referred to as "dry weather flow") with the addition of stormwater runoff during periods of wet weather (collectively referred to as "wet weather flow"). Domestic wastewater includes sewage from a household. Industrial wastewater includes industrial processing waste including solids and liquids.

A "combined sewer system" collects domestic and industrial wastewater, and stormwater runoff. This mixture is called combined sewage. A "separated sanitary sewer" collects domestic and industrial wastewater. A "stormwater sewer system" collects stormwater. During dry weather or small rainstorms, combined sewage from combined sewer systems and wastewater from sanitary sewer systems receive full treatment before discharge to receiving waters. During larger rainstorms, inflows can exceed the capacity of these sewer systems or the wastewater treatment plant itself. The excess flows are known as combined sewer overflows (CSOs) and sanitary sewer overflows (SSOs) "Wet weather flow" discharges include combined sewer overflows, sanitary sewer overflows, and stormwater runoff. Dry and wet weather flow include both sewer solids and liquid. Combined sewer overflows, stormwater runoff, and sanitary sewer overflows are major contributors to the degradation of many urban lakes, streams and rivers.

CSOs and SSOs may be diverted respectively to CSO and SSO storage tanks to substantially reduce or eliminate the frequency and volume of CSOs/SSOs to receiving waters. These storage tanks are located in order to intercept the CSOs/SSOs before they enter the receiving waters. They store the excess wet weather flow during rainstorms. Stormwater storage tanks similarly store excess stormwater during rainstorms. During this period, sewer solids in the wet weather flow settle to the bottom of the tank. When flows subside after a rainstorm, their liquid contents are drained or pumped back into the appropriate sewer systems and conveyed to the wastewater treatment plant where they are treated. After the liquid contents of the tank are emptied, the settled solids remain on the floor of the tank. Sewer solids deposited in combined sewer and sanitary sewer systems during low flow dry weather periods are major contributors to the CSO/SSO-pollution load, causing serious water quality and health problems.

One of the underlying reasons for considerable sewer solids deposition is the combined sewer hydraulic design. Combined sewers are sized to convey many times the anticipated peak dry weather flow. Combined sewers can carry up to 1000 times the expected background sewage flow. Ratios of peak to average dry weather flow usually range from 2 to 10 for interceptor sewers. The oversized combined sewer segments possess substantial sedimentation potential during dry-weather periods. Dry weather flow velocities are typically inadequate to maintain settleable solids in suspension, and a substantial amount of sewer solids tends to accumulate in the pipes. During rain storms, the accumulated solids may resuspend and, because of the limited hydraulic capacity of the interceptor sewers, overflow to receiving waters. Suspended solids concentrations of several thousand parts per million are not uncommon for CSOs. This can produce shock loadings detrimental to receiving waters. Accumulation of sewer solids in sewer pipes also results in a loss of flow carrying capacity that may restrict/block flow and cause an upstream surcharge or local flooding.

Sewer solid accumulation in urban drainage systems also creates septic conditions that pose odor, health hazards, and corrosion problems for these systems. "Sewer solids" as used herein may include sediment, sludge, debris or the like. "Combined sewer system" as used herein includes both combined sewers and CSO storage tanks. "Sanitary sewer system" as used herein includes both sanitary sewers and SSO storage tanks. "Urban drainage system" as used herein includes combined sewers, sanitary sewers, stormwater sewers, and CSO/SSO/stormwater storage tanks.

A variety of flushing systems have been used to purge the sewer solids deposited in combined sewers, stormwater conveyance systems and CSO storage tanks. By creating high-speed flushing waves to resuspend deposited solids, the resuspended solids are washed to strategic locations such as to a point where the wastewater stream is flowing with sufficient velocity, to another point where flushing will be initiated, to a storage sump which will allow later removal of the stored contents, or the wastewater treatment plant. Flushing reduces the amount of solids resuspended during storm events, lessens the need for CSO treatment and sludge removal at downstream storage facilities and allows the conveyance of more flow to the wastewater treatment plant or to the drainage outlet.

One such system is the Hydrass® flushing system comprised of a balanced hinged gate. The gate is weighted to close during low flows allowing the flow to be retained behind the gate. Once the force created by the retained water becomes sufficient, the gate tilts. This releases the surcharged water and flushes the sediment from the sewer. Once the force of the surcharged water is relieved, the gate returns to the closed position to repeat the line surcharging.

Another system is the Hydroself® flushing system which uses a storage impoundment to retain water. Periodically this water is released creating a hydraulic surge which flushes deposited sediment from the storage tank floor and along sewer lines. The release can be triggered manually or automatically with a preset water level monitor and controller.

The gate flushing system also requires a storage impoundment for the flush water. This is created by erecting two walls in the sewer pipe. A heavy gate is placed in the sewer or storage tank perpendicular to the flow and water is held behind the gate. When the water level behind the gate reaches a predetermined level, the heavy gate is opened and water is released to flush sediment downstream of the gate. The impoundment floor must have a slope of 5 to 20% to prevent debris accumulation. When the water reaches a predetermined level, it is released causing a hydraulic surge that flushes the storage tank and sewer line.

The tipping flushers system uses a cylindrical stainless steel vessel suspended above the maximum water level on the back wall of the storage tank. The system requires a water filling system. As the vessel is filled with water, the center of gravity shifts and causes the vessel to rotate and discharge its contents down the back wall of the tank. A curved fillet at the intersection of the wall and tank floor redirects the flush water horizontally across the floor of the storage tank. The flushing force removes the sediment and debris from the tank floor and transports it to a collection sump located at the opposite end of the tank. These flushing systems all require an extramural source of water and/or complex control instrumentation.

Accordingly, there has been a need for a novel system and method that substantially removes sewer solids from urban drainage systems between storms. There is also a need for a novel system and method that may be used in urban drainage systems for substantially reducing sewer solids and associated pollutants from reaching receiving waters. There is a still further need for a novel system and method that operate under atmospheric pressure and hydrostatic head build-up. There is an additional need for a novel system and method that do not require an extramural source of water for flushing. There is a still further need for a novel system and method that do not require complex control instrumentation. There is an additional need for a novel system and method that is cost effective. The present invention fulfills these needs and provides other related advantages.

SUMMARY OF THE INVENTION

In accordance with this invention, the system comprises, generally, at least one flush reservoir within an urban drainage system, the at least one flush reservoir having an ingress and egress port therein through which wet weather flow is received from and discharged in a surge to the urban drainage system, an air intake conduit for drawing air into the at least one flush reservoir, and an air release valve that closes when the at least one flush reservoir is substantially full to create a vacuum on draining of the urban drainage system, the vacuum breaking when the urban drainage system is drained to a level permitting the intake of air to break the vacuum in the flush reservoir, thereby discharging the wet weather flow from the at least one flush reservoir to flush accumulated sewer solids from the urban drainage system.

The at least one flush reservoir defines a box-like receptacle having a top portion and downwardly-extending sidewalls. The floor of the flush reservoir is the floor of the CSO/SSO/stormwater storage tank or sewer line flush chamber in which the at least one flush reservoir may be installed.

The ingress and egress port may be provided in one of the sidewalls along the bottom edge thereof. The flush reservoir opens to the sewer line flush chamber or storage tank through the ingress and egress port. The height of the port is about two to about four inches greater than the historical height of the sediment (sewer solid) layer.

The air intake conduit may extend from an upper opening in the flush reservoir to a lower opening along a sidewall other than the sidewall with the ingress and egress port. The air intake conduit may be in the form of a rectantular duct defined by a partition wall or in the form of an air intake tube connected to the flush reservoir at the upper opening by a tee joint. The lower opening may be sized to be about thirty percent of the size of the ingress and egress port. The lower opening may be about two to three inches higher than the top of the ingress and egress port.

The air release valve for the at least one flush reservoir is installed through the top of the flush reservoir above the maximum level of wet weather flow in the flush reservoir. The air release valve may be a check valve that permits the release of air from the at least one flush reservoir when it is filling with wet weather flow.

The at least one flush reservoir may be installed in an upstream end of the storage tank and/or sewer line with the ingress and egress port facing the downstream end of the storage tank or sewer line flush chamber. The ends of the flush reservoir may be mounted to the floor of the storage tank or sewer line flush chamber. When installed in the CSO/SSO/stormwater storage tank or sewer line, the volume of the flush reservoir may be about 10–20 percent of the volume of the storage tank. For sewer line applications, the flush reservoir volume may be about 20–50% of the volume of the total length of the sewer line to be flushed. The at least one flush reservoir may be sized to fit through the manhole for installation in the sewer. Preferably, there is at least one flush reservoir for every 500–1000 feet of sewer.

In use during a storm, when the storage tank or sewer line flush chamber downstream of the flush reservoir is filling up with wet weather flow during a storm, wet weather flow enters the flush reservoir through the ingress and egress port in the flush reservoir. As the liquid level rises in the flush reservoir, positive pressure automatically opens the air release valve allowing air to purge from the flush reservoir. When the flush reservoir is full, the air release valve automatically closes.

During draining of the sewer or storage tank (e.g. after a storm), a vacuum is created in the air space of the flush reservoir which holds the liquid up in the flush reservoir. When liquid in the sewer or storage tank is drained to a predetermined level (below the elevation of the air intake conduit opening), air is drawn into the flush reservoir via the air intake conduit, breaking the vacuum inside the flush reservoir. Thus, liquid in the flush reservoir is quickly released through the ingress and egress port to the downstream storage tank or sewer resuspending the settled sewer solids and transporting them to a sediment pit for final disposal.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 9 is an enlarged fragmented plan view of a sewer line flush chamber in a portion of an underground sewer line, the sewer line flush chamber accessed through a pair of manholes;

FIG. 10 is an enlarged fragmented longitudinal sectional view taken generally along the line 10—10 of FIG. 9, illustrating the flush reservoir of FIGS. 1–5 installed in the sewer line flush chamber;

FIG. 11 is an elevational plan view of the flush reservoir installed in the sewer line flush chamber taken generally along the line 11—11 of FIG. 10;

FIG. 12 is a cross-sectional view of the sewer line flush chamber with the flush reservoir taken generally along the line 12—12 of FIGS. 10 and 11;

FIG. 23 is a cross-sectional view of the flushed sediment layer, illustrating the topography of the sediment layer before and after laboratory gate flushing;

FIG. 31 is a schematic view of the function of the flush reservoir, illustrating the relationship of air pressure outside the flush reservoir (atmospheric pressure) and inside the flush reservoir at air-water interfaces;

DETAILED DESCRIPTION OF THE PREFERRED EMBODIMENTS

Figure 1:
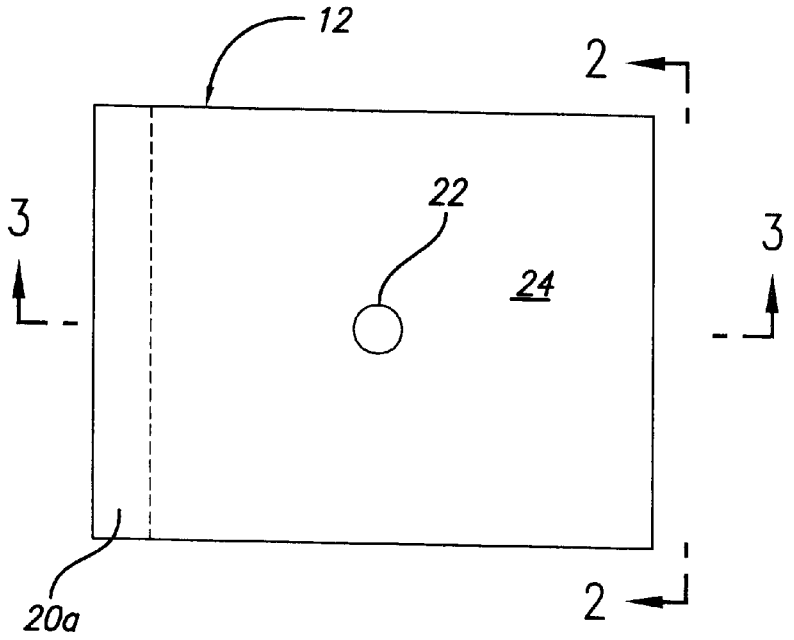
FIG. 1 is a top plan view of a flush reservoir used in a vacuum flushing system in accordance with the first embodiment of the invention, illustrating an air release valve mounted on the top of the flush reservoir and an air intake conduit defined by a partitioning wall shown in dotted lines.

As shown in the drawings for purposes of illustration, the present invention is concerned with a novel vacuum flushing system for an urban drainage system, generally designated in the accompanying drawings by the reference number 10. The method for substantially preventing accumulation of sewer solids in such systems is also provided. As used herein, "urban drainage system" refers to combined sewers, sanitary sewers, stormwater sewers, and CSO/SSO/stormwater storage tanks.

In accordance with the present invention, and as illustrated with respect to a preferred embodiment in FIGS. 1–17, the system comprises at least one flush reservoir 12 having an ingress and egress port 14 in fluid communication with the urban drainage system 16 for receiving and discharging wet weather flow 18, an air intake conduit 20*a* or 20*b* for providing air into the at least one flush reservoir, and an air release valve 22 for the at least one flush reservoir that releases air from the at least one flush reservoir during rising wet weather flow and closes when the at least one flush reservoir is substantially full of wet weather flow to create a vacuum on draining of the urban drainage system, the vacuum broken by the intake of air when the level of wet weather flow in the urban drainage system is drained to a predetermined level thereby discharging the wet weather flow from the at least one flush reservoir to flush accumulated sewer solids 23 from the urban drainage system.

A first embodiment of the invention is shown in FIGS. 1–12. As shown therein, the at least one flush reservoir 12 defines a box-like receptacle having a top portion 24 and downwardly-extending sidewalls 26*a–d* (sidewalls 26*b* and 26*c* not shown). The floor of the at least one flush reservoir 12 is the floor of a CSO/SSO/stormwater storage tank 28 or flush chamber 30 in the sewer line 32 (also referred to herein as a "sewer line flush chamber") in which the at least one flush reservoir 12 may be installed as hereinafter described. Although a rectangular flush reservoir is shown, it is to be appreciated that other shapes may be used within the confines of the invention. For example, a cylindrical flush reservoir may be well suited for a cylindrical sewer pipe. The at least one flush reservoir 12 may be constructed of prefabricated stainless steel, reinforced fiberglass, plastics such as HDPE or HPPVC, or precast concrete to give it strength and rigidity in harsh weather conditions, make it durable, and corrosion resistant.

Figure 2:
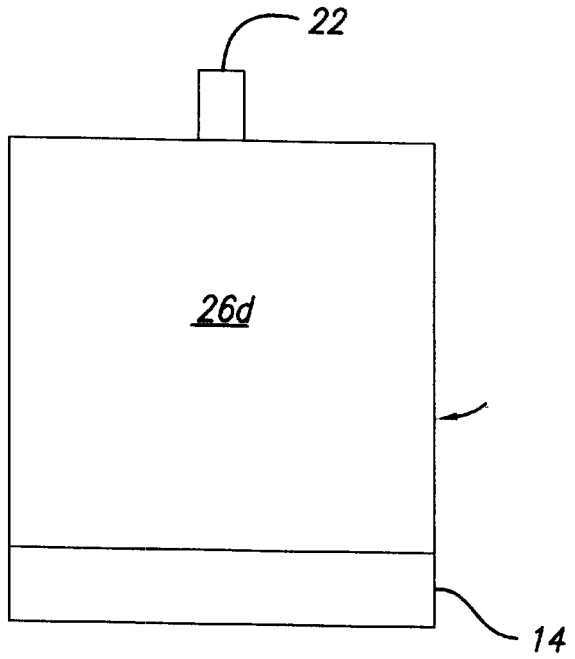
FIG. 2 is a side view of the flush reservoir taken generally along the line 2—2 of FIG. 1, illustrating an ingress and egress port in a sidewall of the flush reservoir and the air release valve in its normal closed condition.
Figure 3:
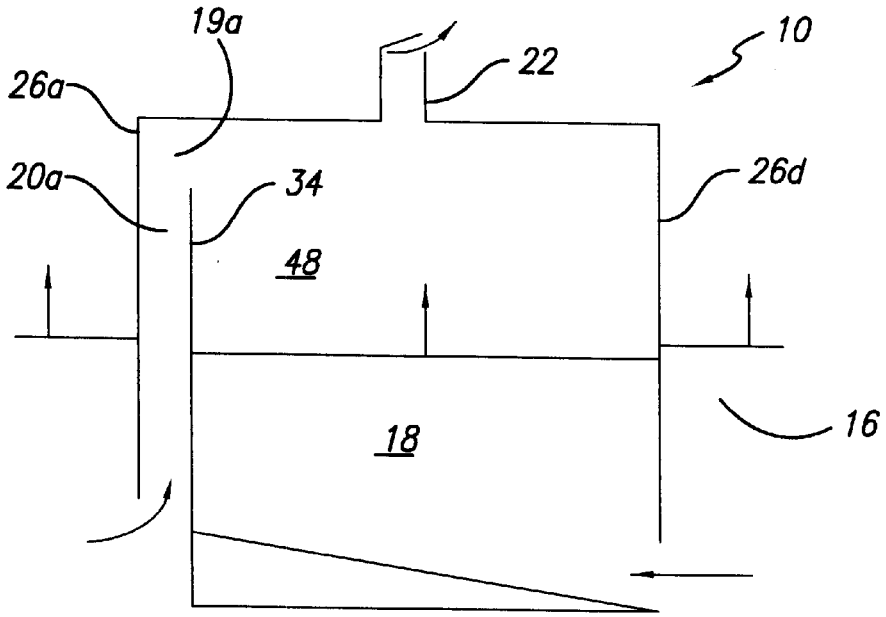
FIG. 3 is an operational view of the vacuum flushing system in an urban drainage system in accordance with the first embodiment of the invention illustrating a sectional view of the flush reservoir taken generally along the line 3—3 of FIG. 1, with a rising level of wet weather flow in the urban drainage system and in the flush reservoir, the air release valve open for releasing air from the flush reservoir.
Figure 4:
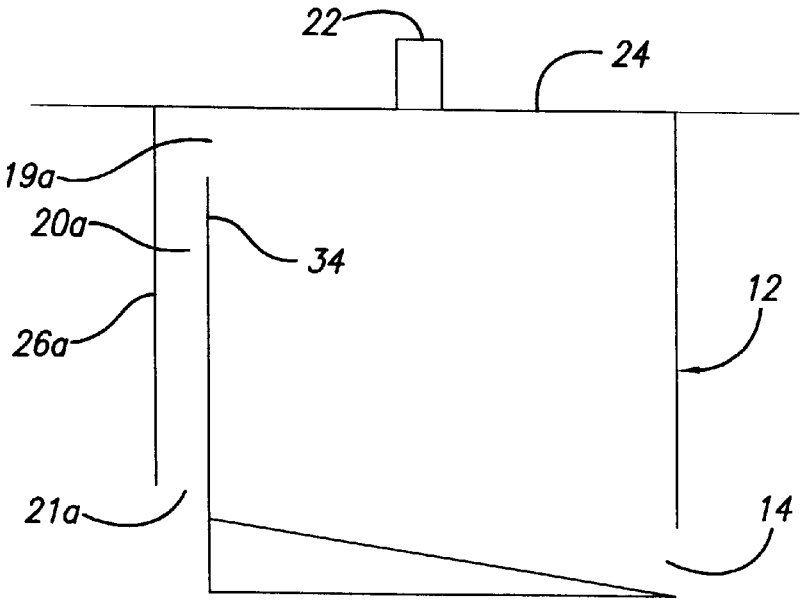
FIG. 4 is another operational view similar to FIG. 3, illustrating the air release valve in the closed position when the level of wet weather flow in the flush reservoir reaches its maximum elevation.
Figure 5:
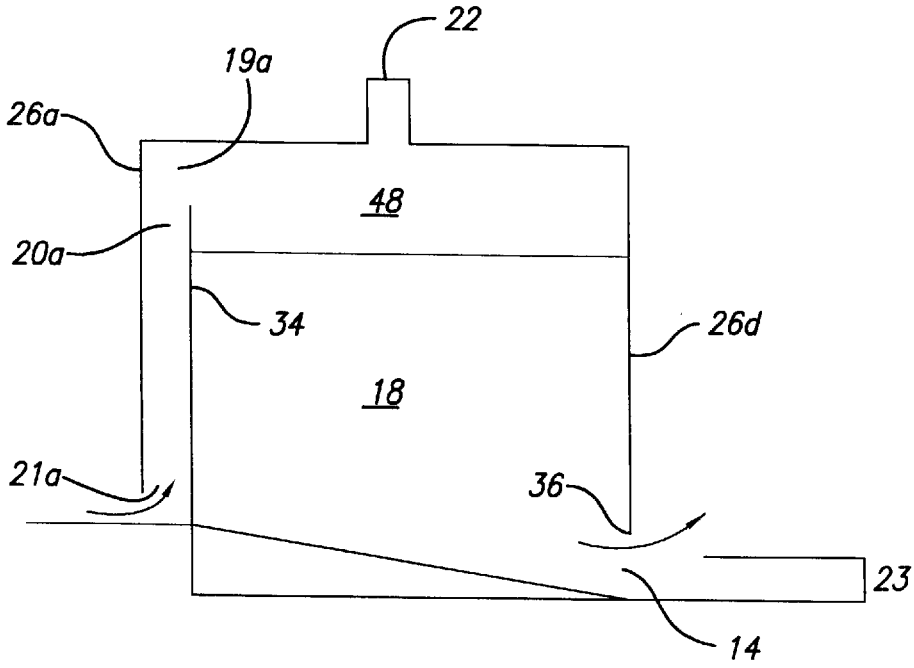
FIG. 5 is another operational view similar to FIGS. 3 and 4, illustrating a surge of the wet weather flow out of the flush reservoir through the ingress and egress port when the urban drainage system is drained below the lower opening of the air intake conduit and the intake of air into the flush reservoir via the air intake conduit.
Figure 17:
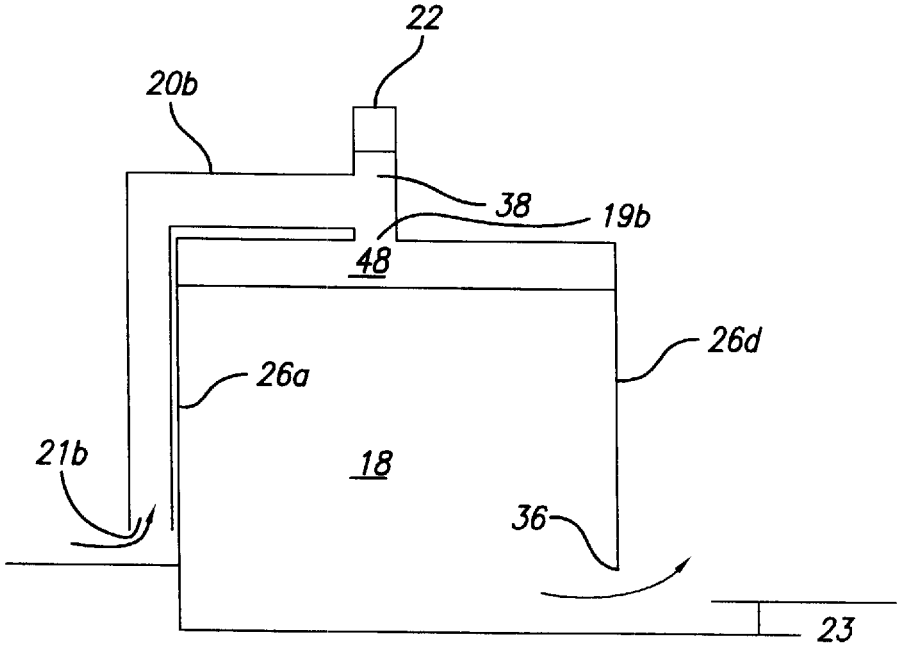
FIG. 17 is another operational view similar to FIGS. 15 and 16, illustrating a surge of the wet weather flow from the flush reservoir of FIG. 13 through the ingress and egress port as the vacuum inside the flush reservoir is broken when the level of wet weather flow therein is lower than the elevation of the lower opening of the air intake conduit.

As shown in FIG. 2, the ingress and egress port 14 may be provided along a bottom edge of the sidewall 26*d*. The at least one flush reservoir 12 opens to the CSO/SSO/stormwater storage tank 28 or sewer line flush chamber 30 through the ingress and egress port 14 as hereinafter described. The width of the port is typically the width of the sidewall 26*d* to substantially avoid flow restriction. The height of the port 14 is preferably about two to four inches above the historical height of the sediment (settled sewer solids 23 as shown in FIGS. 5 and 17) layer immediately downstream of the installed flush reservoir 12. This means that if the historical height of the sediment level is two inches, the height of the port would be 4–6 inches. The historical height of the sediment layer is determined by the value between median and maximum height of the sediment layer in that location measured over a period of at least 24 months, based on the characteristics of local land use, sewer line and hydrology of drainage basin.

In a first embodiment as shown in FIGS. 1–12, the air intake conduit 20*a* may be a rectangular duct defined by a partitioning wall 34. The air intake conduit 20*a* extends from an upper opening 19*a* near the top portion 24 of the at least one flush reservoir 12 to a lower opening 21*a* at a lower elevation along any sidewall other than sidewall 26*d* with the ingress and egress port 14. The air intake conduit 20*a* is shown in FIGS. 1–5 in the sidewall 26*a* opposite the sidewall with the ingress and egress port. The bottom of the lower opening 21*a* and 21*b* of the respective air intake conduit 20*a* and 20*b* may be placed about two to three inches higher than the top 36 of the ingress and egress port i.e. about 4 to 6 inches above the historical height of the sediment (sewer solids 23) layer. If the sediment level is lower than the historical height of the sediment layer, the placement of the air intake conduit remains unchanged. If the sediment layer is more than six inches higher than the historical height, the conduit may have to be raised accordingly. If the sediment layer is occasionally more than the historical height, but less than six inches more, the flushing system may be somewhat less efficient. As shown in FIG. 31, the size of the air intake conduit may be calculated based on the procedures outlined in the section of Numerical Modeling and Discussion below by using Equation 22 as hereinafter described. The size of the air intake conduit may be determined based on the relationship of air pressures outside and inside the flush reservoir As a rule of thumb, however, the area of the air intake conduit may be about twenty percent to about forty percent, preferably thirty percent of the size of the ingress and egress port.

The air release valve 22 is installed through the top of the flush reservoir 12 as shown in FIGS. 1–8 and 10–16 to permit the flow of air out of the flush reservoir. The air release valve 22 is installed above the maximum level of wet weather flow 18 in the at least one flush reservoir 12. The air release valve 22 may be mounted through the top of the flush reservoir 12 by nuts and bolts or the like (not shown). The air release valve 22 may be a one-way check valve and include an elastomeric flange as part of the valve. Suitable air release valves include, but are not limited to, the Tideflex Check Valves Series 35 available from Red Valve Company, Inc.

In a second preferred embodiment as shown in FIGS. 13–17, the air intake conduit 20*b* may be in the form of an air intake tube. The air intake conduit 20*b* connects by a tee joint 38 from an upper opening 19*b* in the top of the at least one flush reservoir 12 and extends to a lower opening 21*b* at a lower elevation along any sidewall other than sidewall 26*d* with the ingress and egress port 14. The air intake conduit 20*b* is shown in FIGS. 13–17 in the sidewall 26*a* opposite the sidewall with the ingress and egress port. The lower opening 21*b* is at the same elevation as the lower opening 21*a*. This embodiment may be preferred for use in a sewer line 32 because of its flexibility.

Figure 6:
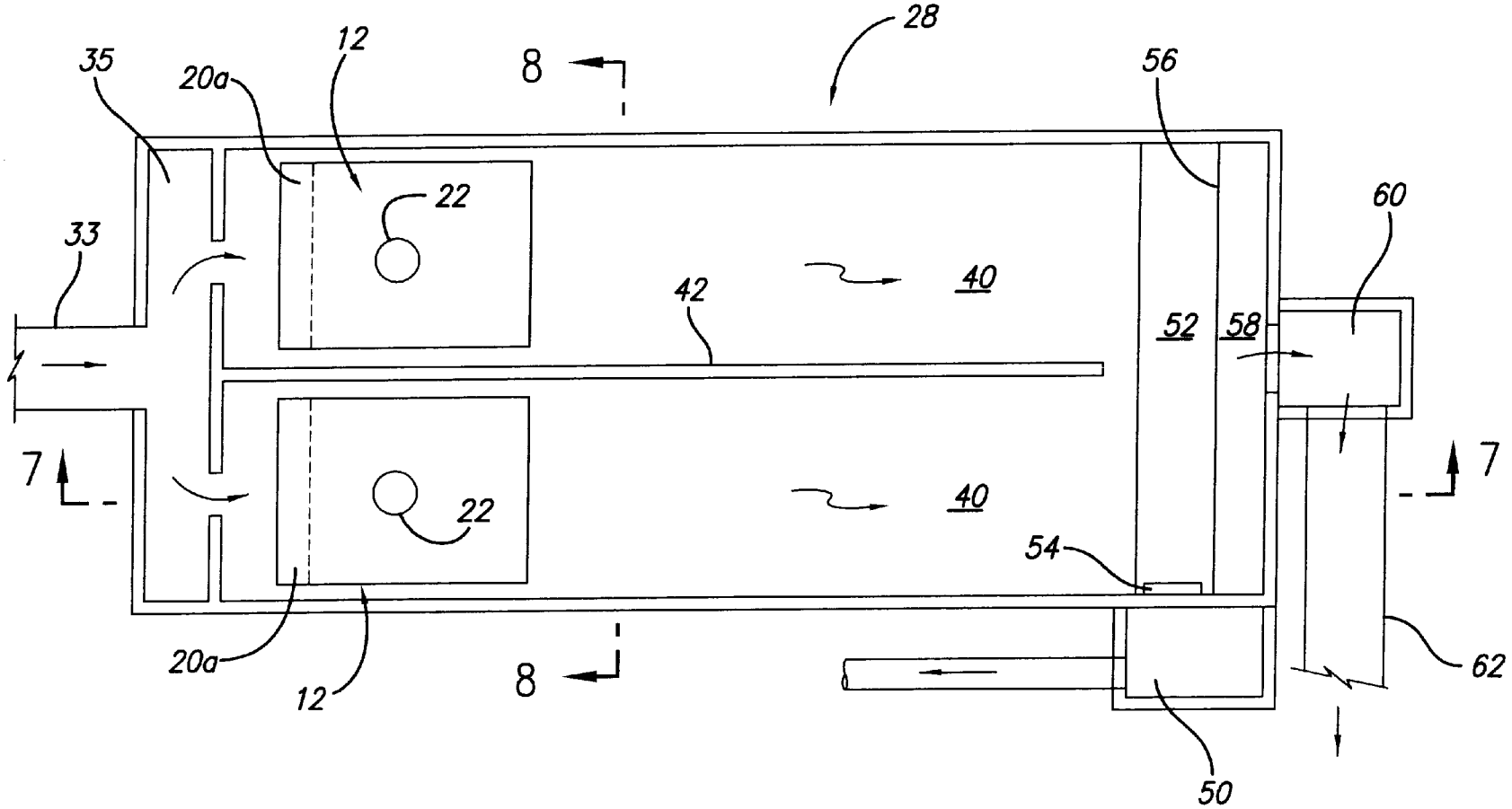
FIG. 6 is a plan view of a combined sewer overflow (CSO) storage tank with a plurality of bays for receiving wet weather flow, illustrating installation of the flush reservoir of FIGS. 1–5 at an upstream end of each of the plurality of bays.
Figure 7:
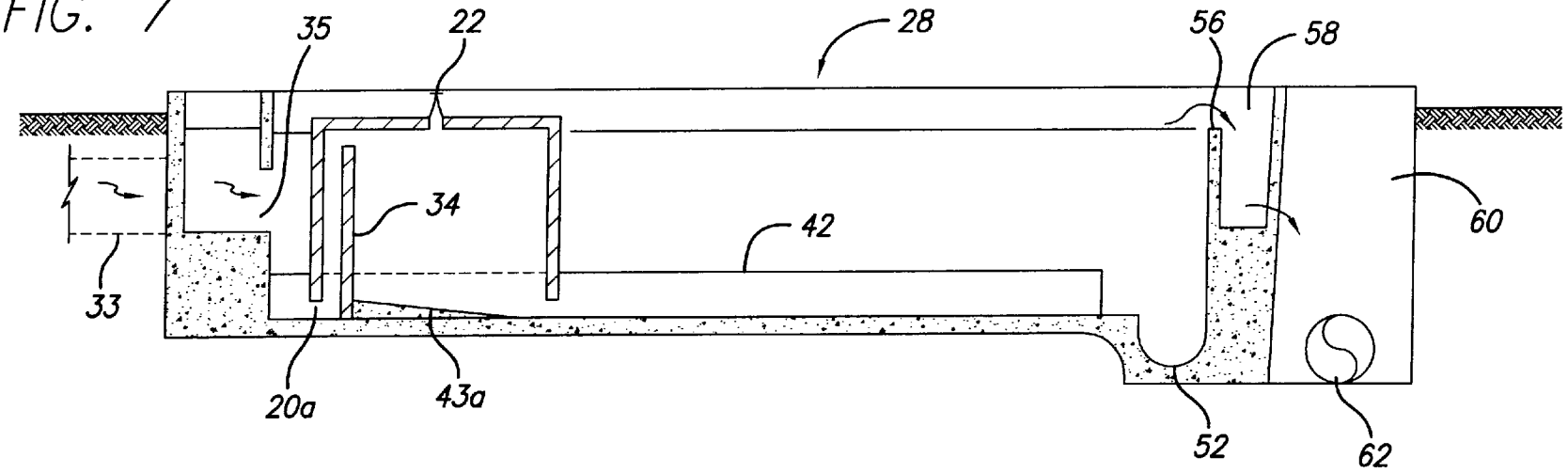
FIG. 7 is an enlarged fragmented longitudinal sectional view of the CSO storage tank taken generally on the line 7—7 of FIG. 6.
Figure 8:
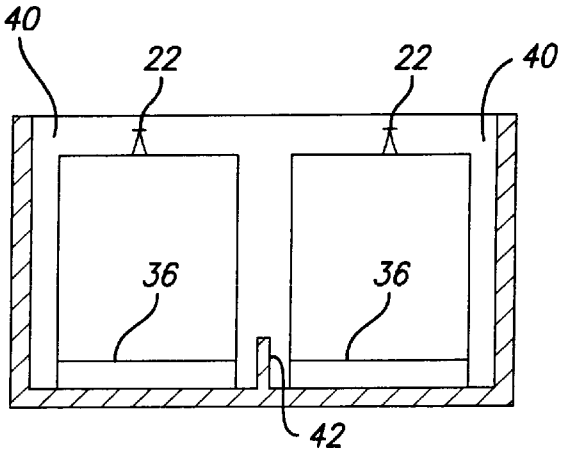
FIG. 8 is an enlarged vertical cross-section view of a portion of the CSO storage tank taken generally on the line 8—8 of FIG. 6.
Figure 13:
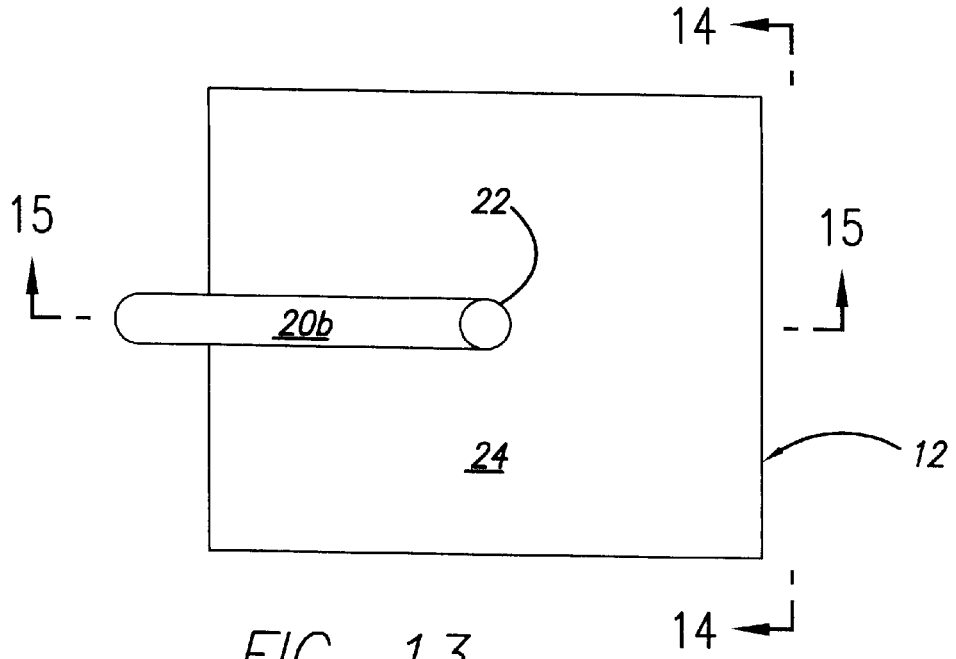
FIG. 13 is a top plan view of a flush reservoir used in a vacuum flushing system in accordance with the second embodiment of the invention, illustrating an air release valve mounted on the top of the flush reservoir and connected by a tee joint to an air intake conduit in the form of an air intake tube.
Figure 14:
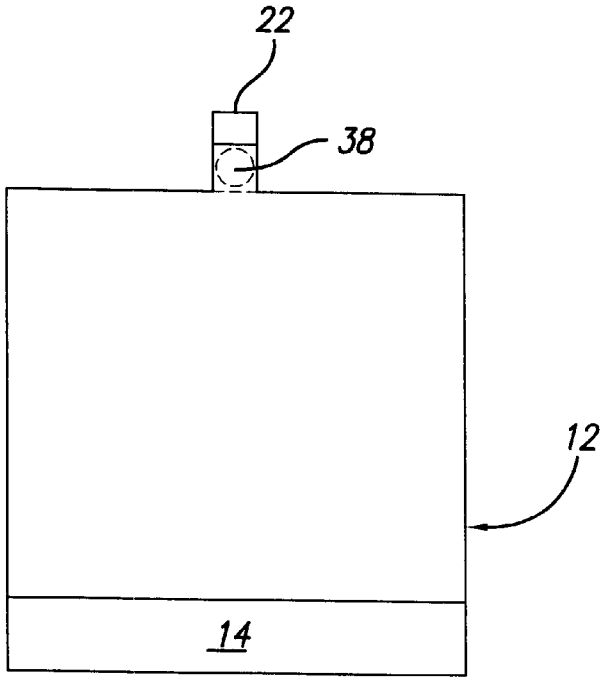
FIG. 14 is a side view of the flush reservoir similar to FIG. 2 taken generally along the line 14—14 of FIG. 13, illustrating the ingress and egress port in a sidewall of the flush reservoir.
Figure 15:
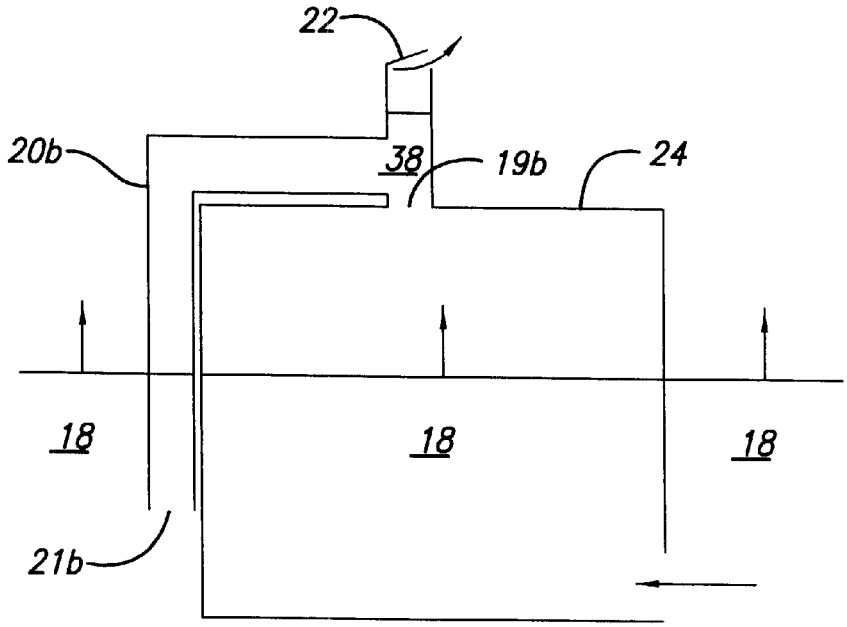
FIG. 15 is an operational view of the vacuum flushing system similar to FIG. 3 in accordance with the second embodiment of the invention, illustrating a sectional view of the flush reservoir of FIG. 13 taken generally along the line 15—15 of FIG. 13, with a rising level of wet weather flow in the urban drainage system and in the flush reservoir, with the air release valve open for releasing air from the flush reservoir.
Figure 16:
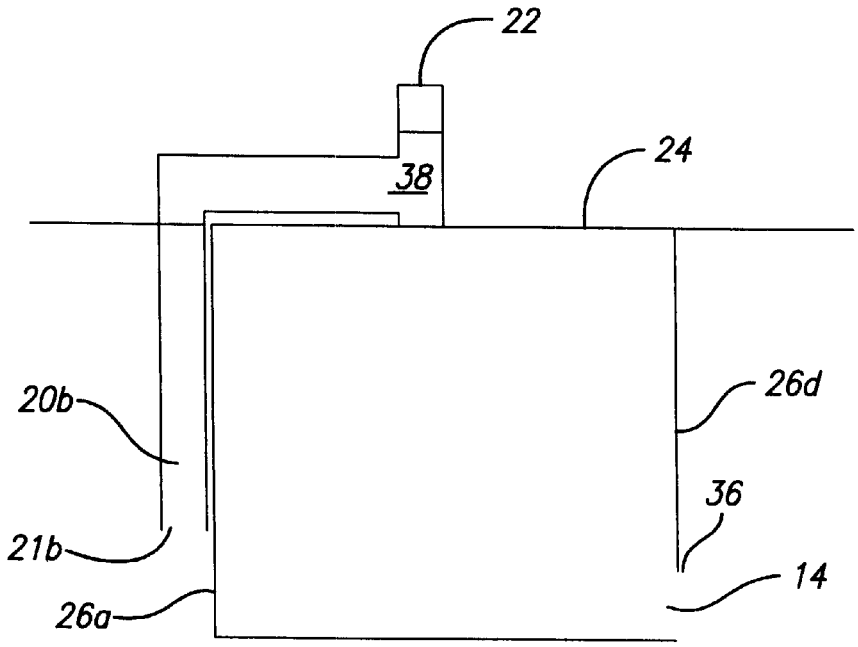
FIG. 16 is another operational view similar to FIG. 15, illustrating the air release valve in the closed position when the level of wet weather flow reaches its maximum elevation in the flush reservoir.

The at least one flush reservoir 12 may be installed in a combined sewer overflow (CSO) storage tank 28 as shown in FIGS. 6–8, a sanitary sewer overflow storage tank (not shown), a stormwater storage tank (not shown), or in a section of a sewer line 32 as shown in FIGS. 9–12. As shown in FIGS. 6–7, the CSO storage tank 28 receives influent (wet weather flow) from an influent sewer 33 through an influent channel 35. The CSO storage tank 28 may be separated into individual bays or compartments 40 by a dividing wall 42 and the flush reservoir 12 may be installed in each of the bays 40 as shown in FIGS. 6 and 8. The at least one flush reservoir 12 may be installed at an upstream end of the storage tank 28 with the ingress and egress port 14 facing the downstream end of the storage tank 28. The ends of the flush reservoir may be mounted to the storage tank floor 43*a* by nuts and bolts or the like (not shown) to keep the at least one flush reservoir 12 firmly in place. The storage tank floor may be sloped, typically at about a 1:5 slope (20%) to substantially prevent solids accumulation on the bottom of the flush reservoir. When installed in the CSO/SSO/stormwater storage tank, the volume of the flush reservoir may be about 10–20 percent of the volume of the storage tank.

As shown in FIGS. 9–12, the at least one flush reservoir 12 may also be installed in a sewer line 32. If the sewer line is 54 inches or less in nominal diameter, as is typically the case, the sewer line 32 may include an inline sewer line flush chamber 30. As is known in the art, a portion of the sewer line is removed and the area around the removed portion excavated and enlarged to receive the inline sewer line flush chamber 30. The sewer line flush chamber 30 is preferably constructed of concrete. The sewer line flush chamber may be accessible for maintenance, etc. through a pair of manholes 44 in the ground 46. The at least one flush reservoir 12 may be installed in the sewer line flush chamber 30 as shown in FIGS. 9–12 with the ingress and egress port 14 facing the downstream end of the sewer line 32. The ends of the flush reservoir may be mounted to the sewer line flush chamber floor 43*b* in substantially the same manner as described above for mounting to the storage tank floor. The sewer line flush chamber floor 43*b* is also sloped in substantially the same manner as the storage tank floor 43*a* to substantially prevent solids accumulation on the bottom of the flush reservoir. The floor elevation of the sewer line flush chamber 30 (and the flush reservoir) may substantially be the same as the elevation of the sewer invert. For sewer line applications, the flush reservoir volume may be about 20% to about 50% of the volume of total length of sewer line to be flushed, depending on local conditions, including the sewer-sediment volume, accumulation rate, sewer hydraulics, the length of sewer line and the sewer pipe size. Preferably, there is at least one flush reservoir for every 500–1000 feet of sewer. The placement of the at least one flush reservoir in the sewer line may be influenced by the historical height of the sediment layer (sewer solids) in that location. If the sediment accumulation in a particular area is historically relatively thick, the placement of the at least one flush reservoir may be indicated there.

In use during a storm, when the storage tank 28 or sewer line 32 downstream of the flush reservoir 12 is filling up with wet weather flow 18 during a storm, wet weather flow 18 enters the flush reservoir 12 through the ingress and egress port 14 in the flush reservoir 12. As the liquid level rises in the flush reservoir (shown in FIG. 3), positive pressure automatically opens the air release valve 22 allowing air to purge from the flush reservoir 12. When the flush reservoir 12 is full, the air release valve 22 automatically closes (shown in FIG. 4).

During draining of the sewer line 32 or storage tank 28 (e.g. after a storm), a vacuum (equivalent to one negative atmospheric pressure, e.g., $-1.0$ kg/cm$^2$) is created in the air space 48 near the top of the flush reservoir 12 which holds the liquid up in the flush reservoir 12. When liquid in the sewer or storage tank is drained to a predetermined level (below the elevation of the air intake conduit lower opening 21*a* and 21*b*), air is drawn into the flush reservoir 12 via the air intake conduit 20*a* or 20*b*. At that moment, the vacuum inside the flush reservoir 12 is broken (as shown in FIG. 5). Wet weather flow 18 in the flush reservoir 12 is quickly released in a surge through the ingress and egress port 14 to the downstream storage tank 28 or sewer line 32, resuspending the settled sewer solids 23. The sewer solids are flushed at a high velocity of more than 2 m/s (>6 ft/s). In the case of the sewer line 32, dry weather flow may also be received in the flush reservoir and discharged therefrom in order to flush sewer solids from the sewer line 32.

As is known in the art, the dividing wall 42 in the CSO storage tank 28 directs the flow of wet weather flow 18 including the resuspended solids down the sloped floor 43*a* of the storage tank 28 and into a trough 52 in the storage tank from where it is drained to a sediment pit 50 through a tank drain gate 54 that is opened after the storm.

The flushed wet weather flow including the resuspended solids from the sewer line may also be drained or pumped to the sediment pit 50 for final disposal to interceptor sewers, to another point where flushing will be initiated, or conveyed to a wastewater treatment plant for treatment.

Excess wet weather flow in the storage tank 28 will overflow through a weir 56 located at the downstream end of the storage tank 28 into an effluent channel 58, then into a discharge chamber 60 before being discharged to receiving waters (e.g. streams, lakes, etc.) through an outfall pipe 62 as shown in FIGS. 6 and 7.

Although the flushing system has been shown in a CSO storage tank, it is to be understood that it operates in the same manner in SSO and stormwater storage tanks.

The method for substantially reducing sewer solid accumulation in an urban drainage system is also provided. The method comprises the steps of providing at least one flush reservoir 12 in a segment of an urban drainage system 16, the at least one flush reservoir 12 having an ingress and egress port 14 in fluid communication with the urban drainage system 16 and an air release valve 22 that closes when the at least one flush reservoir is substantially full of wet weather flow to create a vacuum therein, providing air to the at least one flush reservoir, and draining the urban drainage system to a level to permit the intake of air that breaks the vacuum causing the wet weather flow to surge out the ingress and egress port to flush accumulated sewer solids from the urban drainage system.

Experimental Methods, Materials, and Results

An experiment was conducted to test the sediment removal efficiency of the vacuum flushing of the present invention as compared to conventional gate flushing. The equipment, materials and procedures used in the laboratory experiment are as follows:

Equipment

Flume

Figure 18:
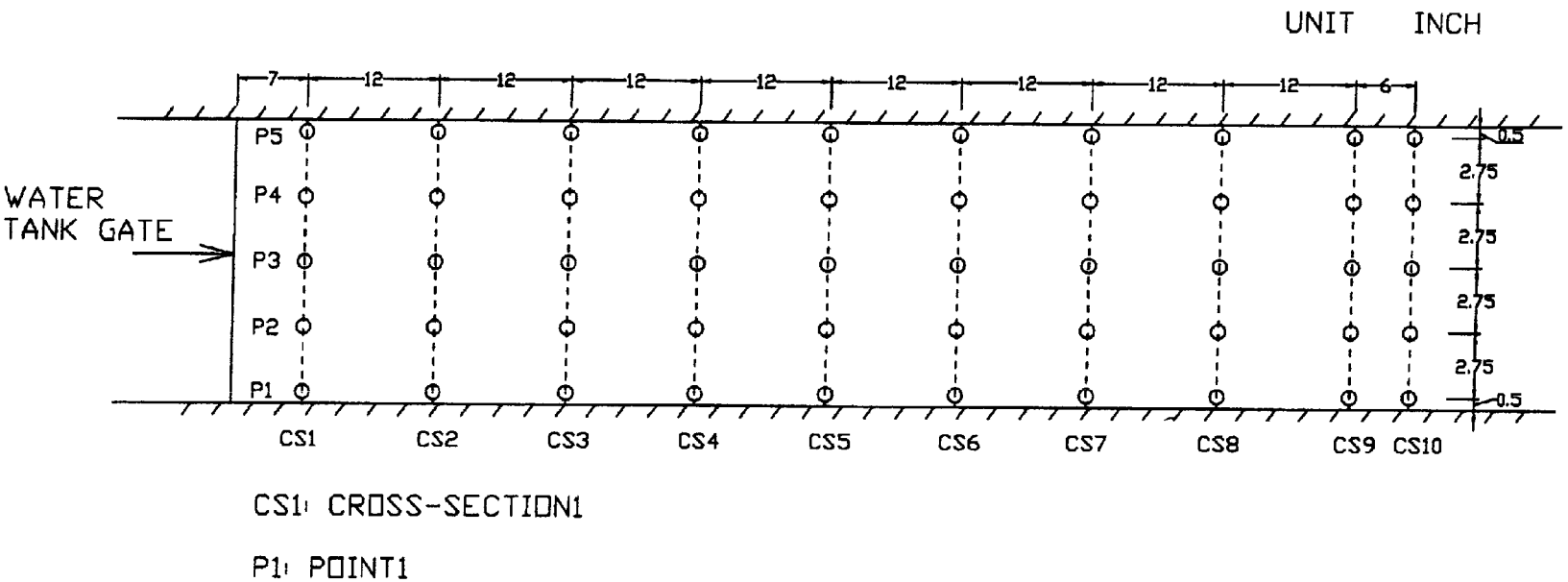
FIG. 18 is a schematic view of the bottom cross section of a laboratory hydraulic testing flume, illustrating the measurement of locations of flushed sediments in the laboratory flume.
Figure 19:
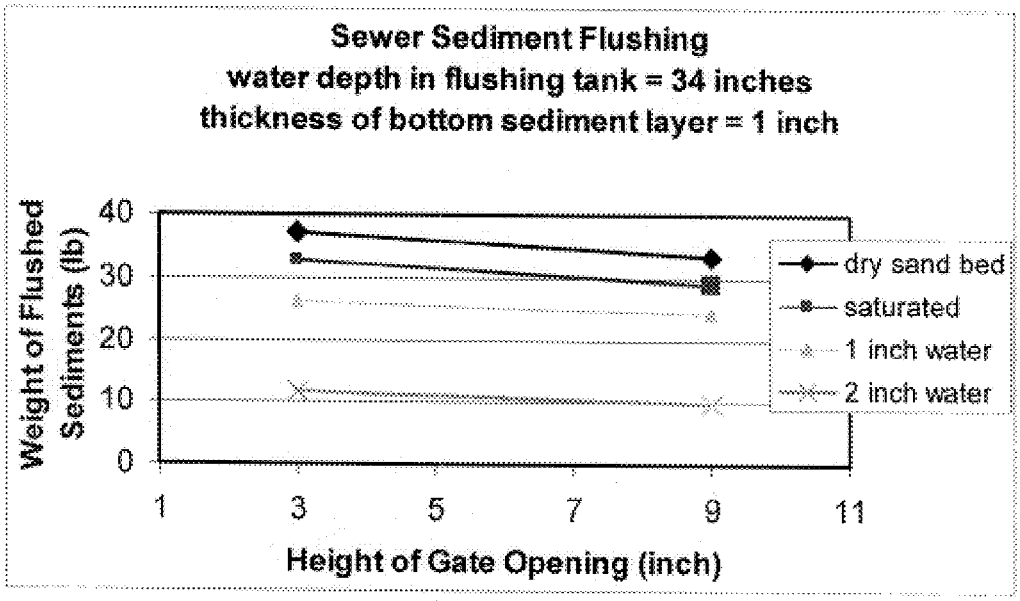
FIG. 19 is a graph, illustrating the weight of flushed sediments from gate flushing tests at different initial water depths in the laboratory flume when the initial water depth in a flushing tank was 34 inches and the initial thickness of the sediment was 1 inch.
Figure 20:
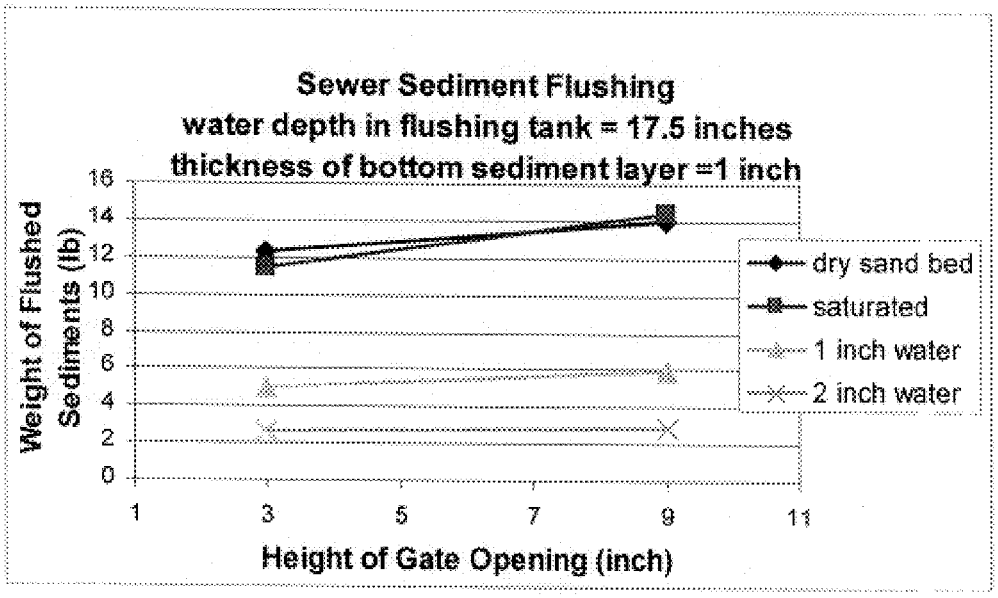
FIG. 20 is a graph, illustrating the weight of flushed sediments from gate flushing tests at different initial water depths in the laboratory flume when the initial water depth in the flushing tank was 17.5 inches and the initial thickness of the sediment was 1 inch.
Figure 21:
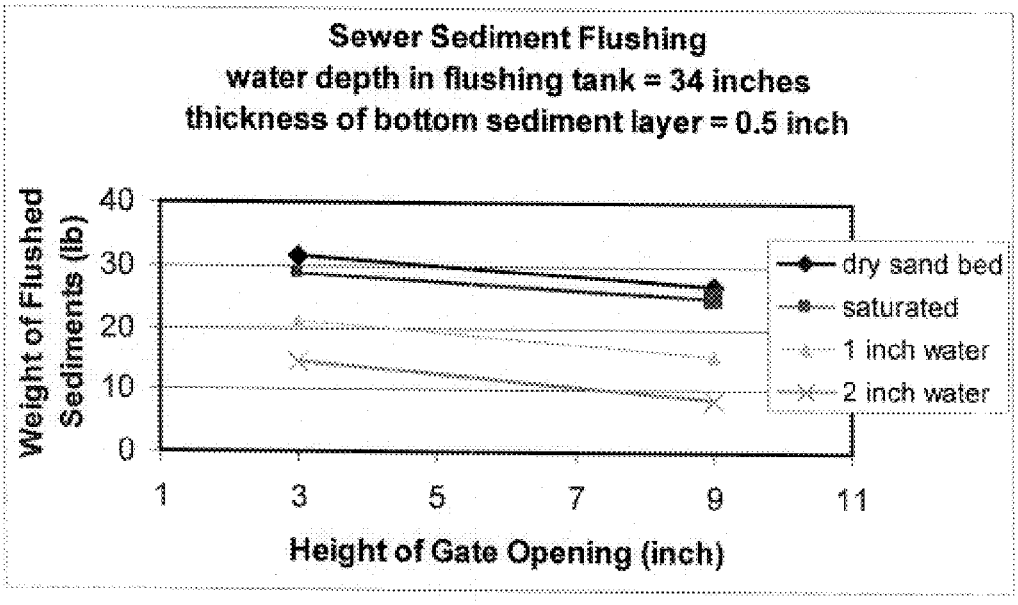
FIG. 21 is a graph, illustrating the weight of flushed sediments from the gate flushing tests at different initial water depths in the laboratory flume when the initial water depth in the flushing tank was 34 inches and the initial thickness of the sediment was 0.5 inches.
Figure 22:
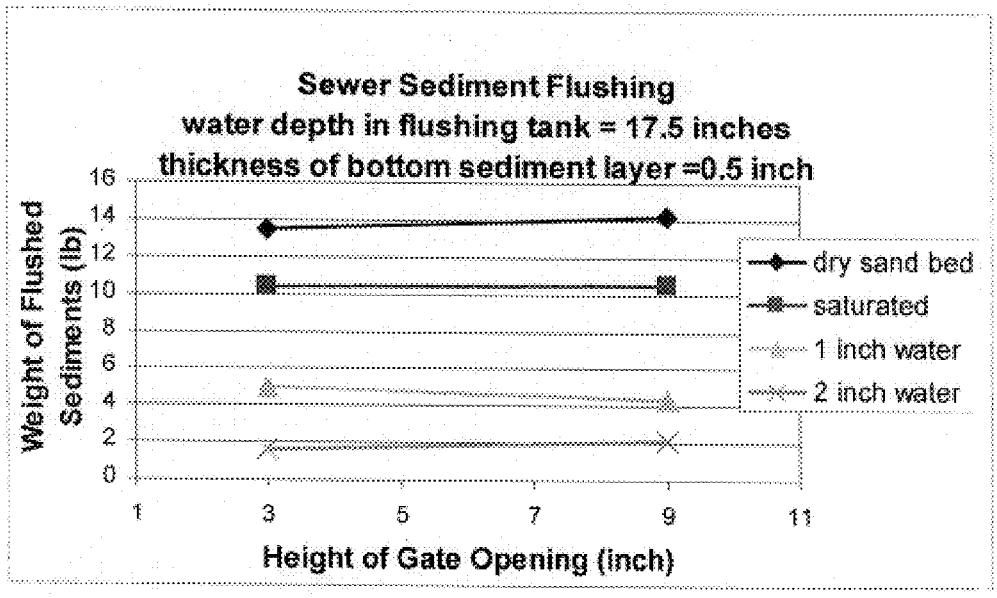
FIG. 22 is a graph, illustrating the weight of flushed sediments from the gate flushing tests at different initial water depths in the laboratory flume when the initial water depth in the flushing tank was 17.5 inches and the initial thickness of the sediment was 0.5 inches.

A hydraulic Demonstration/Sediment Transportation Channel or flume as shown in FIG. 18 was used to simulate a reach of sewer or storage tank. The channel was purchased from Engineering Laboratory Design, Inc., Lake City, Minn. It is a self-contained, recirculating channel, designed for use as a student laboratory flume and for small scale sediment transportation studies. The unit consisted of a transparent plexiglass channel, a head tank with an adjustable undershot gate, an adjustable tailgate, a reservoir, two circulating pumps, and a flow metering system. The supporting framework incorporated an elevating mechanism for varying the slope of the channel bed. All wetted parts of the equipment were made of non-corrosive materials. Its overall dimensions were: Length, 19 feet 5 inches (5.92 m); Width, 8 feet 10 inches (2.69 m); Height, 6 feet 10 inches (2.08 m). The working section of the channel was 12 inches (30 cm) wide; 18 inches (46 cm) deep; 15 feet (4.57 m) long and fabricated from 0.5 inch (13 mm) thick, clear plexiglass. The channel discharged into a 32.0 $ft^3$ (0.91 $m^3$) reservoir fabricated from a composite lamination of fiberglass and rigid PVC foam core.

Flush reservoir

A rectangular tank was placed at the head of the flume to simulate both the gate and vacuum flushing reservoirs. Water was stored in the rectangular tank with the top open and with a vertical gate on the downstream side. A metal frame was clamped to the gate to hold it against the side of the tank. Upon unclamping the metal frame, the gate moved in a vertical direction swiftly under action of a rubber spring and water in the tank was released to the downstream channel. The gate was set to move up to a predetermined position for a desired gate opening size.

Outside dimensions of the tank were: 36 inches (0.91 m) high, 36 inches (0.91 m) long, and 11 inches (28 cm) wide. One-inch (25 mm) thick Acrylic sheet was used to make the top cover, bottom floor, three side walls, and the gate. Therefore, inside dimensions of the tank were: 34 inches (86 cm) high, 34 inches (86 cm) long, and 9 inches (23 cm) wide. Three 6-inch (15 cm) holes were cut on the top cover to simulate the open cover.

The depth of water and thickness of sediments initially in the channel/flume downstream of the flushing tank were controlled through placement of an Acrylic sheet and a weir near a downstream end of the flume. One sheet was one-inch (25 mm) thick, 2 feet (61 cm) long, and 12-in (30 cm) wide. Another sheet was half inch (13 mm) thick, 2 feet (61 cm) long, and 12-in (30 cm) wide. The weir was 3 inch (76 mm high), 12-in (30 cm) wide, and 3/16 inch (5 mm) thick. The sheet and the weir were surrounded by a rubber lining for a watertight fit.

A tailgate in the flume was removed and a thin metal sheet placed at the end of the flume to direct flushing water and flushed sediments to the reservoir. A basket made of metal wire mesh was placed in the reservoir at the end of the flume to intercept the flushing water and the flushed sediments. A fine cloth was placed over the basket to let water through but retain sediments.

Laboratory Oven

The oven was used to dry flushed sediments to constant weight at 103–105° C.

Digital Balance

The balance was used to weigh mass. Pelouze®Balance, Model PE10, Bridgeview, Ill., with capacity of 10 pounds and weight increment of 0.2 oz (capacity of 5,000 g with weight increment of 5 g) was used in the tests.

Digital Point gauge

The point gauge was used to measure thickness of sediment layer before and after flushing. It was purchased from Engineering Laboratory Design, Inc., Lake City, Minn. Measurement range is 200 mm (8.0 inches), accuracy is ±0.025 mm (0.001 in), and resolution is 0.01 mm (0.0005 in). The apparatus employs a Mitutoyo Digimatic Scale Unit which offers precise linear measurement capabilities with the added benefits of LCD readout, selectable SI or English units, adjustable zero, and data/hold capabilities. The gauge was constructed of aluminum, brass, and stainless steel. A precision spur gear and rack allowed convenient manual adjustment of the point location.

Digital Video Camera

Digital video camera was used to record water and sand movements during flushing. It was a 3Com®HomeConnect™ PC Digital Camera, Model No. 3718, Santa Clara, Calif. Video camera recorded 30 picture frames per second. Spatial positions were established using markings on the flushing tank and the flume.

Sonic Sifter

The sonic sifter was used to analyze size distribution of the sediments. The ATM Model L3P Sonic Sifter is a superior sieving instrument, especially suitable for ultra-fine particle separation by the dry sieve method in the sub-sieve range, i.e., for particles smaller than 37 microns and down to 5 microns. It is a portable instrument designed for fast, accurate particle separation analysis. The ATM L3P Sonic Sifter can separate most materials from No. 20 sieve screen size (850 microns) down to a 5-micron sieve screen size. Some materials can be separated up to a No. 3.5 sieve screen size. The manufacturer specifies that the accuracy of the measurement is expected to be ±20% (80–120% percent recovery).

Materials

Sediment (noncohesive)

Sand was used as noncohesive sediments in the tests. The sand was purchased from U.S. Silica Company, Mauricetown, N.J. under product name Sand-NJ with mesh size # 90. Specific gravity of the sand was specified by the vendor as 2,650 kg/m3, and mean diameter as 0.14 mm. An ATM Sonic Sifter (model L3P) was used to analyze the sediment side distribution.

Sediment (cohesive)

Cohesive sediments were made in the laboratory by using sand, laponite RD clay, and water. The sand was the same as that used as noncohesive sediments. Laponite RD clay was purchased from Southern Clay Products, Inc., Gonzales, Tex. Water was taken from public water supply tap. Eighteen (18) grams of laponite clay were mixed with one liter of water to make gel by stirring for a few minutes. Then gel was mixed with sand in a mass proportion of 30 to 70. The mixture was let sit for one hour to develop the cohesion force. The mixture was then placed on the bottom of the flume for another hour before the flushing tests began. The clay-water-sand ratio was taken from recommendations given by Alvarez-Hernandez, E. M. (1990), The influence of cohesionon sediment movement in channels of circular cross section, PhD Thesis, University of Newcastele upon Tyne, UK for making synthetic sewer sediment.

Water

Water used in the flushing tests was taken from public water supply tap in the laboratory.

Experimental Procedures a. The flush reservoir (tank) was placed at the head of the flume. The flume was at horizontal level.

b. A digital video camera was placed in front of the flume with a view of the entire flume.

c. An Acrylic sheet of desired thickness (one or half inch thick with the weir was placed near the downstream end of the flume.

d. The desired amount of sediment was placed on the bottom of the flume between the flushing tank at the upstream end and the front edge of the Acrylic sheet at the downstream end. The sediment was spread and leveled. When the thickness of the sand layer was desired to be one inch, 75 pounds of sand were used, and Acrylic sheet of one-inch thick was used. When the thickness of the sand layer was desired to be half inch, 37.5 pounds of sand were used, and Acrylic sheet of half-inch thick was used. The thickness of the laid sand layer was measured at fifty locations, 10 along the flume and 5 across the flume. For the cohesive sediment, the sediment sat on the bottom of the flume for one hour before flushing.

e. The flush reservoir was filled with water to a desired level.

f. Water was gently put from both ends of the flume to have a desired water depth in the flume. Because the tank was taller than the flume, the flush tank was filled through the air valve opening. If sand was desired to be saturated with water, to have one-inch water depth above the sand layer, or have two-inch water depth above the sand layer.

g. The digital video camera was turned on.

h. For the gate flushing, the gate was opened and water was released from flushing tank. For vacuum flushing of both noncohesive and cohesive sediment, two of the three holes on top of the tank were covered with thermal plugs. The third hole was connected to a PVC air valve. The air valve opening on top of the tank was closed by placing a gasket over it to create a vacuum in the tank. The gate of the flushing tank was opened to a desired level to create a vacuum in the tank. The tank was opened to outside atmosphere by removing the gasket from the valve opening and the vacuum disappeared and water was released from the tank.

i. The digital video camera was turned off.

j. Sediments collected on the Acrylic sheet and collected on the cloth sheet at the downstream basket were put in an oven and dried for an extended period of time (five or more hours until dry).

k. Dried sediments were weighed for total amount of flushed sediments.

l. Water in the flume was drained and thickness of sediments remained in the flume was measured using the point gauge.

m. Digital video images were played back on the computer monitor. The sequence number of each frame was recorded on the paper. The water level in the tank, position of flushing surge front, and shape of the flushing surge were quantified from the image in reference to spatial markings on the tank and the flume. The sequence number was converted to time instance based on the video recording speed of 30 frames per second. Positions based on the spatial markings were converted to X-Y coordinates with the origin at the bottom of the flume and the downstream side of the flushing tank.

Experimental Results (illustrated in FIGS. 19–26)

Removal of noncohesive sediment by conventional gate flushing

For studying amount of noncohesive sediment removal by gate flushing, a total of 32 flushing conditions were tested. Weights of eroded (flushed) sediments under these 32 flushing conditions are shown in Table 1 below and FIGS. 19–23.

TABLE 1

Total Weight of Sediments Flushed in Gate Flushing

| Run No. | Initial Water Level in the Flushing Tank (in) | Initial Sand Layer Thickness (in) | Initial Water Depth (in) | Gate Opening Size (in) | Weight of Eroded Sand (lb) |
|---|---|---|---|---|---|
| 1 | 17.5 | 1 | Dry | 3 | 12.308 |
| 2 | 17.5 | 1 | Saturated | 3 | 11.392 |
| 3 | 17.5 | 1 | 1 | 3 | 4.934 |
| 4 | 17.5 | 1 | 2 | 3 | 2.652 |
| 10 | 17.5 | 1 | Dry | 9 | 13.972 |
| 12 | 17.5 | 1 | Saturated | 9 | 14.402 |
| 11 | 17.5 | 1 | 1 | 9 | 5.914 |
| 35 | 17.5 | 1 | 2 | 9 | 2.875 |
| 5 | 34 | 1 | Dry | 3 | 37.024 |
| 6 | 34 | 1 | Saturated | 3 | 32.844 |
| 7 | 34 | 1 | 1 | 3 | 26.028 |
| 38 | 34 | 1 | 2 | 3 | 11.640 |
| 14 | 34 | 1 | Dry | 9 | 33.276 |
| 15 | 34 | 1 | Saturated | 9 | 28.964 |
| 16 | 34 | 1 | 1 | 9 | 24.238 |
| 36 | 34 | 1 | 2 | 9 | 9.75 |
| 27 | 17.5 | 0.5 | Dry | 3 | 13.470 |
| 28 | 17.5 | 0.5 | Saturated | 3 | 10.340 |
| 29 | 17.5 | 0.5 | 1 | 3 | 4.940 |
| 30 | 17.5 | 0.5 | 2 | 3 | 1.61 |
| 39 | 17.5 | 0.5 | Dry | 9 | 14.25 |
| 41 | 17.5 | 0.5 | Saturated | 9 | 10.538 |
| 49 | 17.5 | 0.5 | 1 | 9 | 4.35 |
| 45 | 17.5 | 0.5 | 2 | 9 | 2.125 |
| 31 | 34 | 0.5 | Dry | 3 | 31.65 |
| 32 | 34 | 0.5 | Saturated | 3 | 28.510 |
| 33 | 34 | 0.5 | 1 | 3 | 21.15 |
| 71 | 34 | 0.5 | 2 | 3 | 14.5 |
| 40 | 34 | 0.5 | Dry | 9 | 29.788 |
| 42 | 34 | 0.5 | Saturated | 9 | 24.75 |
| 44 | 34 | 0.5 | 1 | 9 | 15.375 |
| 46 | 34 | 0.5 | 2 | 9 | 8.613 |

The following is observed from the test results:

1. Weight of flushed sediments increases with the increase of initial water depth in the flushing tank. Larger volume (and more energy) of available water induces larger weight of eroded sediments.
2. Weight of flushed sediments decreases with the increase of initial water depth in the flume. Larger initial water depth in the flume causes more resistance to the flushing surge/wave released from the flushing tank, thus less weight of eroded sediments.
3. Weight of flushed sediments is almost the same for two different initial weights of sediments (i.e., two different initial sediment layer thicknesses) in the flume. This indicates that the sediment transport rate is not limited by the amount of sediment weight available on the bed under these two conditions.
4. When initial water depth in the flushing tank is 34 inches, weight of flushed sediments decreases with the height of gate opening. However, when initial water depth in the flushing tank is 17.5 inches, weight of flushed sediments increases with the height of gate opening.
5. When the initial sediment layer thickness in the flume is one inch, up to 50 percent of bottom sediments is flushed away. When the initial sediment layer thickness in the flume is 0.5 inch, up to 85 percent of bottom sediments is flushed away.

A typical spatial distribution of flushed/eroded sediments (Run No. 38) is shown in Table 2 and FIG. 23. Most of the sediments are flushed near the outlet of the flushing gate, and sediments are completely cleaned out near the outlet.

TABLE 2

Sand Layer Thickness Before and After Flushing

| | Position | | | | |
|---|---|---|---|---|---|
| | Before Flushing (thickness in inches) | | | | |
| CS1 | 1.075 | 1.075 | 1.190 | 1.281 | 1.380 |
| CS2 | 0.959 | 1.060 | 1.091 | 1.164 | 1.235 |
| CS3 | 1.160 | 1.177 | 1.125 | 1.011 | 0.944 |
| CS4 | 1.204 | 1.313 | 1.363 | 1.352 | 1.059 |
| CS5 | 1.279 | 1.212 | 1.166 | 1.121 | 1.087 |
| CS6 | 1.391 | 1.316 | 1.262 | 1.196 | 1.197 |
| CS7 | 1.155 | 1.214 | 1.275 | 1.195 | 1.243 |
| CS8 | 1.192 | 1.138 | 1.086 | 1.259 | 1.283 |
| CS9 | 1.105 | 0.919 | 0.959 | 0.942 | 1.104 |
| CS10 | 1.064 | 1.025 | 0.991 | 1.020 | 1.069 |
| | After Flushing (thickness in inches) | | | | |
| CS1 | 0.063 | 0.063 | 0.087 | 0.093 | 0.076 |
| CS2 | 0.062 | 0.087 | 0.095 | 0.092 | 0.115 |
| CS3 | 0.646 | 0.388 | 0.486 | 0.451 | 0.324 |
| CS4 | 0.759 | 0.772 | 0.826 | 0.937 | 0.868 |
| CS5 | 1.174 | 1.118 | 1.087 | 1.080 | 1.034 |
| CS6 | 1.224 | 1.315 | 1.296 | 1.273 | 1.304 |
| CS7 | 1.299 | 1.405 | 1.446 | 1.357 | 1.394 |
| CS8 | 1.389 | 1.407 | 1.437 | 1.458 | 1.483 |
| CS9 | 1.258 | 1.209 | 1.175 | 1.180 | 1.162 |
| CS10 | 1.246 | 1.267 | 1.243 | 1.229 | 1.210 |

CS1: Cross-Section 1
P1: Point 1

Amount and distribution of noncohesive sediment removal by vacuum flushing

Weight of flushed sediments under vacuum flushing for a total of 12 is shown in Table 3. A comparison of amount of flushed sediments between gate and vacuum flushing under 6 identical conditions is made in Table 4. Averaging over the six runs, six more percent of sediments is flushed by vacuum flushing than gate flushing. Two factors may make a difference in flushing efficiency between vacuum and gate flushing. If the top opening of the vacuum flushing tank/chamber is too small, the vacuum may not disappear quickly and water release from the vacuum flushing tank may be slower than gate flushing tank. This would reduce weight of flushed sediments by vacuum flushing in comparison to gate flushing. However, if the gate in the gate-flushing tank is opened more slowly than the gasket is removed from air valve in the vacuum flushing tank, water release from the gate flushing tank would be slower. This would make vacuum flushing more efficient than gate flushing. From the test results, these two factors seem not to make a significant difference in the flushing efficiency.

TABLE 3

Total Weight of Sediments Flushed in Vacuum Flushing

| Run NO. | Initial Water Level In Flushing Tank (in) | Initial Sand Layer Thickness (in) | Initial Water Depth (in) | Gate Opening Size (in) | Weight of Eroded Sand (lb) |
|---|---|---|---|---|---|
| 20 | 17.5 | 1 | 1 | 2 | 2.050 |
| 21 | 17.5 | 1 | 2 | 2 | 0.772 |
| 51 | 34 | 0.5 | 0.75 | 1 | 8.75 |
| 50 | 34 | 0.5 | 1.5 | 2 | 8.4125 |
| 52 | 34 | 0.5 | 2.75 | 3 | 1.7 |
| 22 | 34 | 1 | 1 | 2 | 12.815 |
| 23 | 34 | 1 | 2 | 2 | 6.911 |

TABLE 3-continued

Total Weight of Sediments Flushed in Vacuum Flushing

| Run NO. | Initial Water Level In Flushing Tank (in) | Initial Sand Layer Thickness (in) | Initial Water Depth (in) | Gate Opening Size (in) | Weight of Eroded Sand (lb) |
|---|---|---|---|---|---|
| 9 | 34 | 1 | 3.5 | 3 | 2.994 |
| 59 | 34 | 1 | 1.25 | 2 | 25.020 |
| 63 | 34 | 0.5 | 1.75 | 2 | 19.30 |
| 64 | 34 | 0.5 | 1.75 | 2 | 19.22 |
| 68 | 34 | 1 | 1.25 | 2 | 25.320 |

TABLE 4

Comparison of Total Weight of Sediments Flushed With Vacuum and Gate Flushing

| Run NO. | Initial Water Level In Flushing Tank (in) | Initial Sand Layer Thickness (in) | Initial Water Depth (in) | Gate Opening Size (in) | Type of Flushing | Weight of Eroded Sand (lb) |
|---|---|---|---|---|---|---|
| 21 | 17.5 | 1 | 2 | 2 | V | 0.772 |
| 24 | 17.5 | 1 | 2 | 2 | G | 1.790 |
| 23 | 34 | 1 | 2 | 2 | V | 6.911 |
| 25 | 34 | 1 | 2 | 2 | G | 8.270 |
| 59 | 34 | 1 | 1.25 | 2 | V | 25.020 |
| 68 | 34 | 1 | 1.25 | 2 | V | 25.320 |
| 56 | 34 | 1 | 1.25 | 2 | G | 23.1 |
| 57 | 34 | 1 | 1.25 | 2 | G | 23.68 |
| 63 | 34 | 0.5 | 1.75 | 2 | V | 19.30 |
| 64 | 34 | 0.5 | 1.75 | 2 | V | 19.22 |
| 61 | 34 | 0.5 | 1.75 | 2 | G | 17.1 |
| 62 | 34 | 0.5 | 1.75 | 2 | G | 17.148 |

Amount and Distribution of Cohesive Sediment Removal by Vacuum Flushing

One run was made on vacuum flushing of cohesive sediments. This is Run No. 53. Initial water depth in the flushing tank was 34 inches, initial thickness of sediment layer in the flume was one inch, initial water depth (above sediment layer) in the flume was one inch, gate opening size was 2 inches. The total weight of flushed sediments was 4.0 pounds. For Run 22 with noncohesive sediments under the same conditions, the total weight of flushed sediments was 12.8 pounds (Table 3). A much larger amount of noncohesive sediments was flushed than cohesive sediments under the same conditions, as expected.

Hydrodynamics and Sediment Transport in the Flume

Figure 24A:
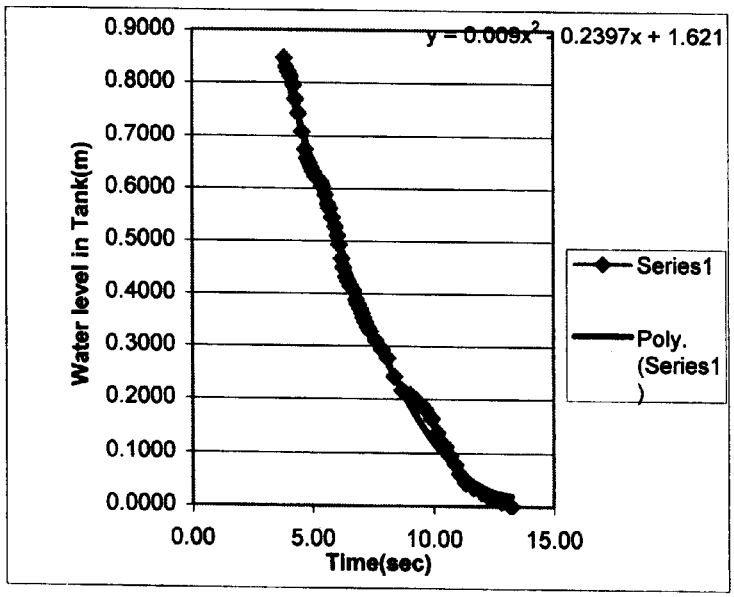
FIG. 24*a* is a graph, illustrating the Measured Time Variations of Water Depth in a laboratory Flushing Tank for Vacuum Flushing Test Run 68.
Figure 24B:
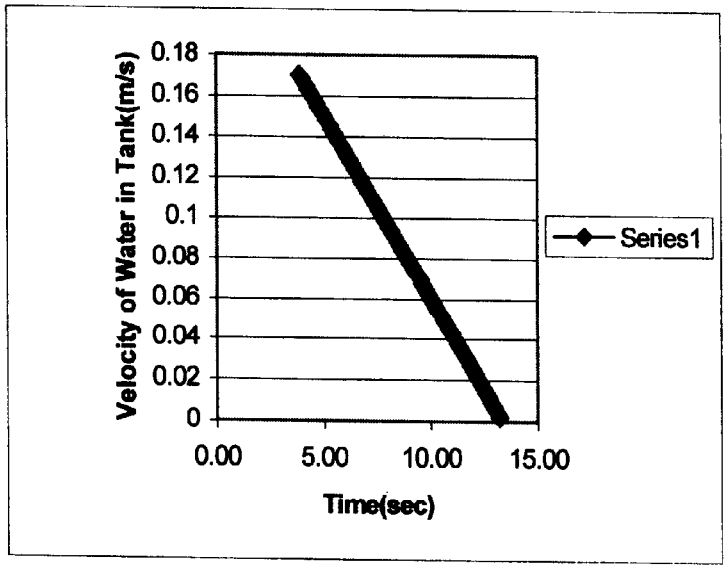
FIG. 24*b* is a graph, illustrating the Measured Time Variations of Water Surface Downward Movement Speed in the laboratory Flush Tank for Vacuum Flushing Test Run 68.
Figure 25A:
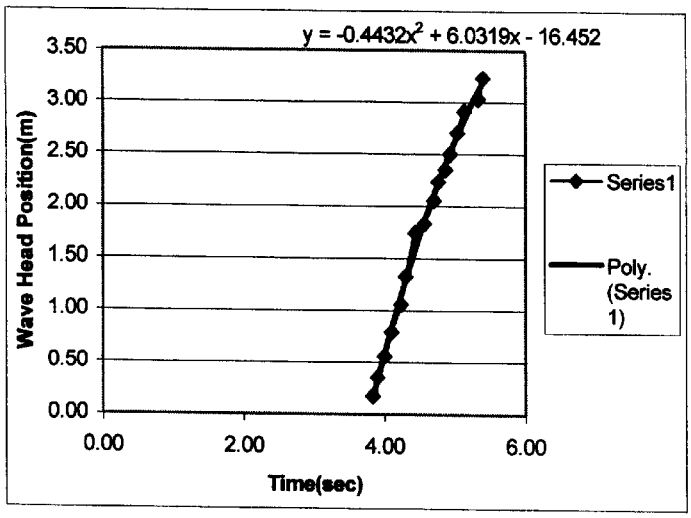
FIG. 25*a* is a graph, illustrating the Measured Time Variations of Surge Head Position in a laboratory flume for Test Run 68.
Figure 25B:
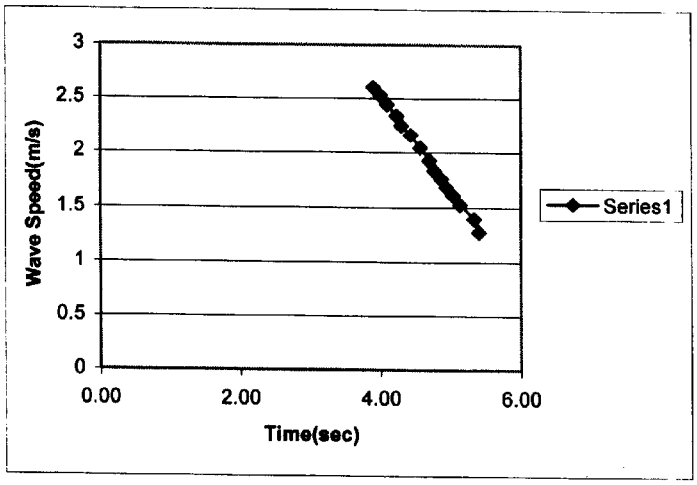
FIG. 25*b* is a graph, illustrating the Measured Time Variations of Surge Speed in the laboratory flume for Test Run 68.
Figure 26:
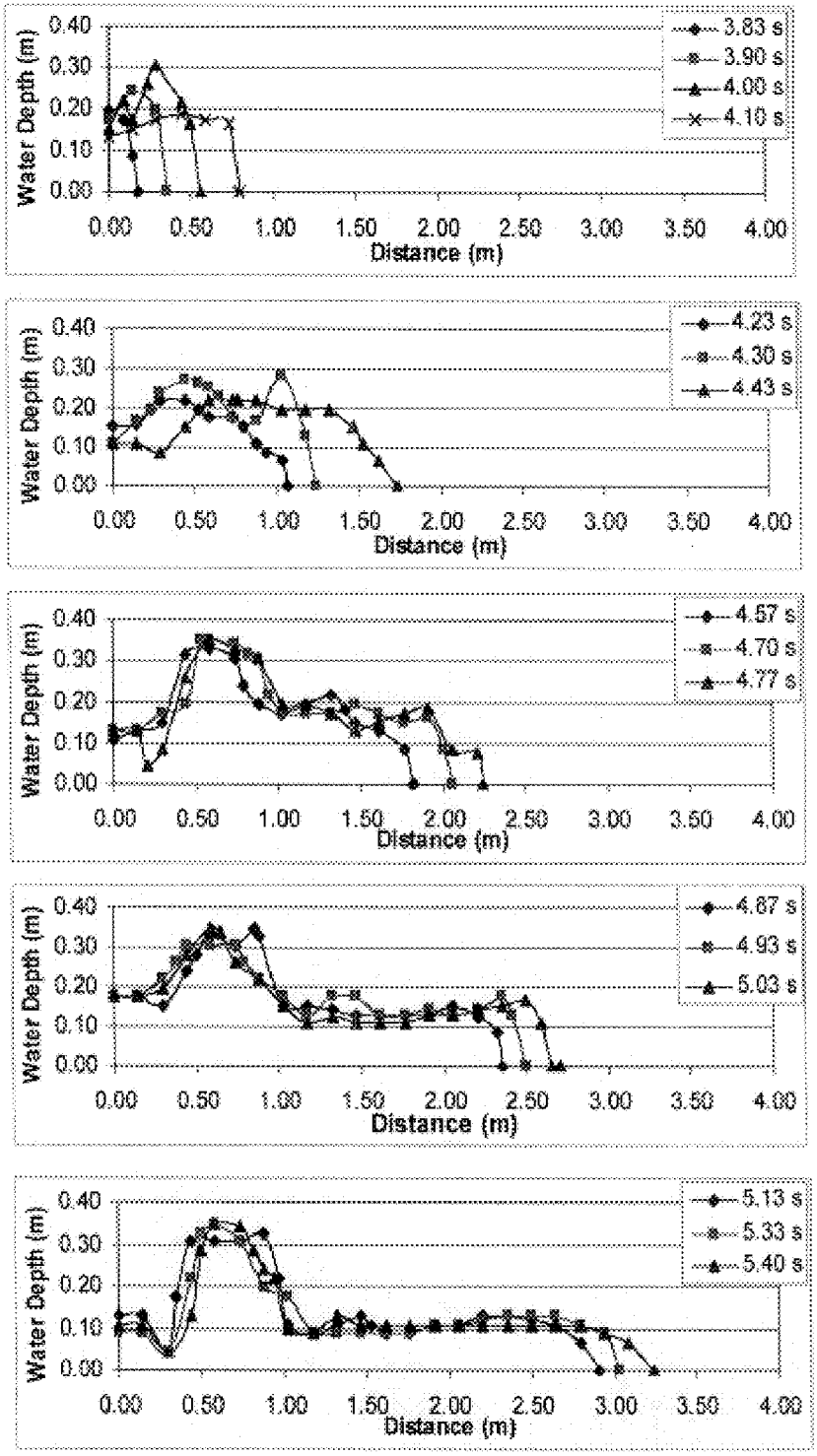
FIG. 26 is a graph, illustrating the Measured Flushing Surge Movements along the laboratory flume for Test Run 68.

A digital video camera was used to record images of hydrodynamics and sediment transport during the flushing process. The recorded video images were digitized to obtain data on water draining velocity in the tank, and speed and shape of the flushing surge in the flume. Images were recoded for a total of ten runs. Data derived from video images for a typical run (Run 68) is presented in FIGS. 24*a* and 24*b*, 25*a* and 25*b*, and 26. FIG. 24*a* shows measured and fitted time variations of water surface elevation in the flushing tank (with datum at the flume bottom), and FIG. 24*b* shows time variation of downward movement speed of water surface in the flushing tank calculated from the fitted time variation of water surface elevation in FIG. 24*a*. FIG. 25*a* shows measured and fitted time variation of distance between the frontal/downstream position of the flushing surge/wave and the frontal/downstream side of the flushing tank, and FIG. 25*b* shows time variation of longitudinal movement speed of surge front calculated from the fitted time variation of surge position in FIG. 25*a*. FIG. 26 shows the shape of the flushing surge at different time instances.

Numerical Modeling and Discussion

The purpose of numerical modeling is to extend measured hydrodynamic and sediment transport data beyond those conditions tested in the laboratory. If the model is tested well with limited measured data, it can be used to derive data that are not measured and project results beyond the tested conditions. FIGS. 27–33 are a result of the numerical modeling.

Figure 27:
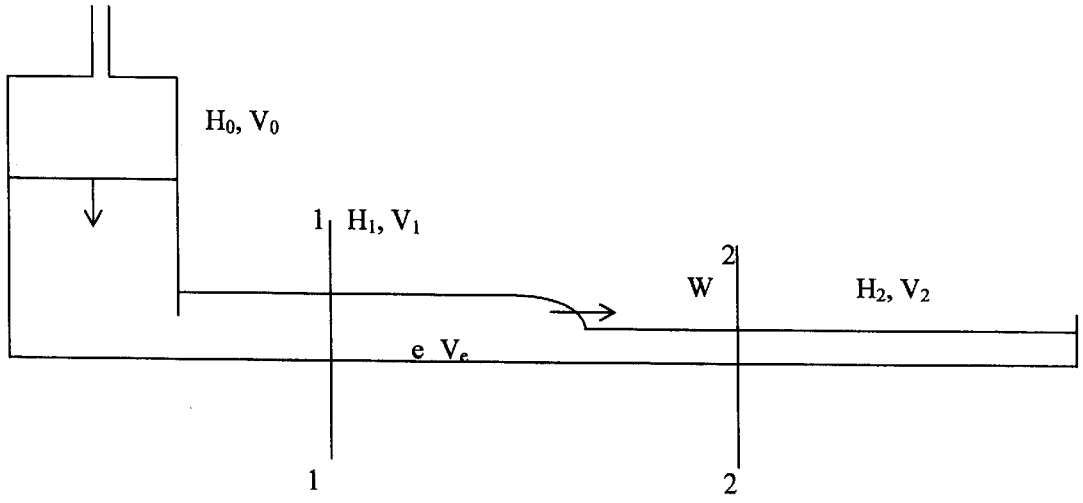
FIG. 27 is a one dimensional steady state hydrodynamic model schematic of the flume for laboratory Test Run 68, illustrating the flushing tank and surge.
Figure 28A:
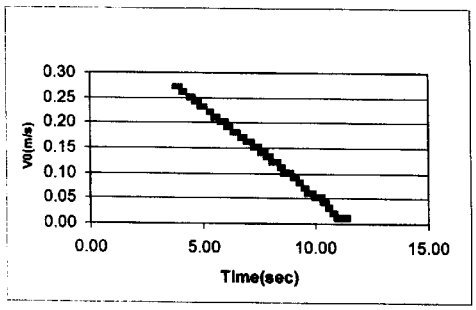
FIG. 28*a* is a graph calculated from the one dimensional steady state hydrodynamic model of FIG. 27 for Test Run 68, illustrating downward water movement velocity ($V_0$) in the flushing tank.
Figure 28B:
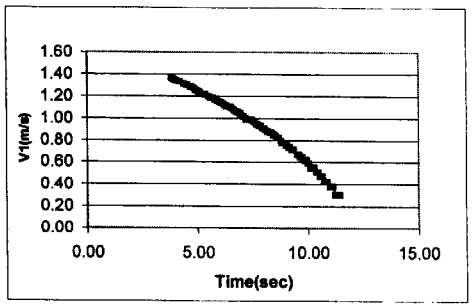
FIG. 28*b* is a graph calculated from the one dimensional steady state hydrodynamic model of FIG. 27 for Test Run 68, illustrating water flow velocity ($V_1$) in the flume.
Figure 28C:
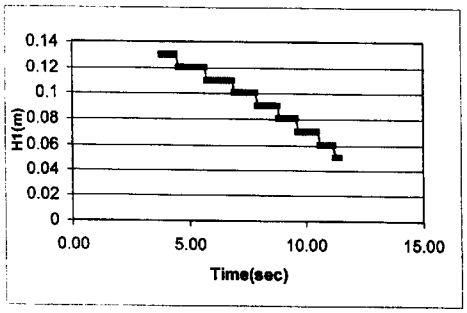
FIG. 28*c* is a graph calculated from the one dimensional steady state hydrodynamic model of FIG. 27 for Test Run 68, illustrating water flow depth ($H_1$) in the flume.
Figure 28D:
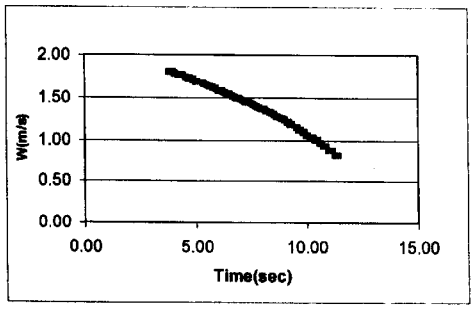
FIG. 28*d* is a graph calculated from the one dimensional steady state hydrodynamic model of FIG. 27 for Test Run 68, illustrating flushing surge speed (W) in the flume.
Figure 29:
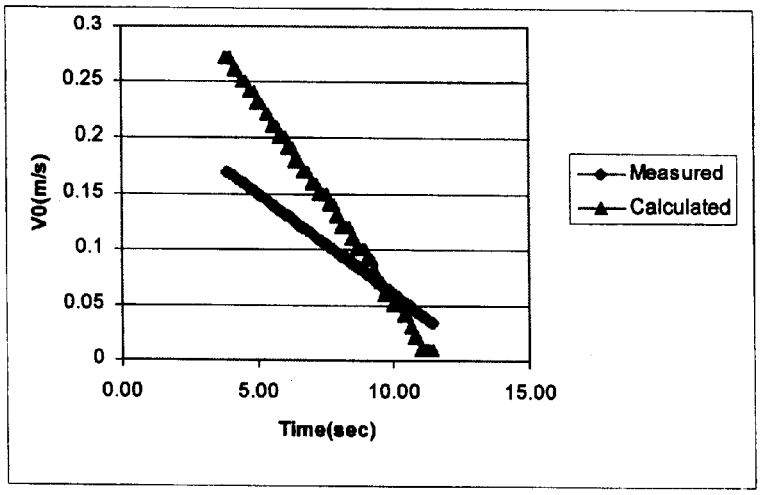
FIG. 29 is a graph, illustrating comparison of the Measured and Calculated Water Surface Downward Movement velocity ($V_0$) in the Flushing Tank for laboratory Test Run 68.
Figure 30:
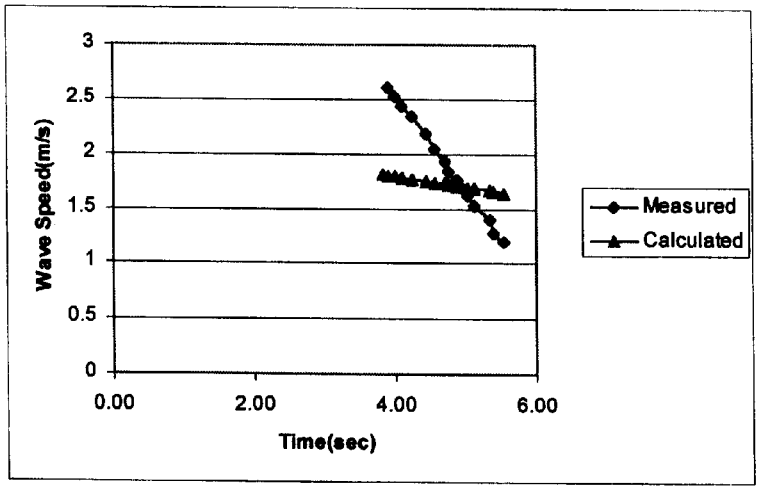
FIG. 30 is a graph, illustrating comparison of the Measured and Calculated Flushing Surge/Wave Speed (W) in the Flume for laboratory Test Run 68.

In the simplified one-dimensional, steady-state model shown in FIG. 27, only flow in one direction is considered, and the variables involved are assumed not to change with time. The flushing flow velocity ($V_1$) depends on four variables: water depth inside the flushing tank ($H_0$), height of the side opening of the flushing tank (e), initial water depth in the flume ($H_2$), and initial velocity in the flume ($V_2$). After these four variables are specified, four equations can be used to solve for four unknowns: flushing flow velocity in the flume ($V_1$), flushing flow depth in the flume ($H_1$), surge (wave) speed (W), and downward water velocity in the flushing tank ($V_0$). These four equations are:

The continuity equation between the reservoir and section 1—1:

$$V_0 \times A_0 = V_1 \times B \times H_1 \quad (1)$$

where $A_0$ is the cross sectional area of water surface inside the reservoir and B is the width of the flume.

The Bernoulli's energy equation between the flushing tank and section 1—1 in the flume:

$$H_0 + \frac{V_0^2}{2g} = H_1 + \frac{V_1^2}{2g} + \xi\frac{V_1^2}{2g} \quad (2)$$

where ξ is the local head loss coefficient at the tank side opening.

The continuity between sections 1—1 and 2—2.

$$(V_1 - W)H_1 = (V_2 - W)H_2 \quad (3)$$

The momentum equation between sections 1—1 and 2—2:

$$\frac{H_2}{g}(V_2 - W)(V_2 - V_1) = \frac{1}{2}(H_1^2 - H_2^2) \quad (4)$$

This momentum equation is written for the case that the slope of the flume is zero and the solid boundary friction is negligible.

In equation (2), the local head loss coefficient is unknown. An estimation of ξ is made below.

When water exits from a pipe into an infinitely large reservoir, the local loss at the exit is:

$$H_{loss} = 1.0\frac{V_e^2}{2g} \quad (5)$$

where $V_e$ is the pipe water velocity at the exit.

In this study, the head loss at the tank side opening is assumed to be the same as the head loss when water flows from a pipe into an infinitely large reservoir. That is, $$\xi\frac{V_1^2}{2g} = 1.0\frac{V_e^2}{2g} \quad (6)$$

Based on the continuity equation, flow velocity at the opening ($V_e$) is related to the flow velocity in the flume ($V_1$) as follows:

$$\frac{V_e}{V_1} = \frac{H_1}{e}$$

Thus $$\xi = \frac{V_e^2}{V_1^2} = \left(\frac{H_1}{e}\right)^2 \quad (7)$$

The four equations (1), (2), (3) and (4) can be used to solve for four unknowns $V_1$, $H_1$, W, and $V_0$ after $H_0$, e, $H_2$, $V_2$, $A_0$, and B are given. The solution procedure follows:

Using equation (3), we can have W as a function of two unknowns $V_1$ and $H_1$:

$$W = f_1(V_1, H_1) \quad (8)$$

Equation (4) gives $V_1$ as a function of unknown $H_1$:

$$V_1 = f_2(H_1) \quad (9)$$

Substituting $V_1$ from equation 9 into equation (1), we obtain $V_0$ as a function of unknown $H_1$:

$$V_0 = f_3(H_1) \quad (10)$$

Substituting equation (7), (9), (10) into equation (2) yields an implicit relationship between unknown $H_1$ and known (given) $H_0$:

$$f_4(H_0, H_1) = 0 \quad (11)$$

Microsoft Excel feature-Goal Seek is used to solve equation (11) for $H_1$ through iterations for a given $H_0$. Values of $V_0$, $V_1$, and W are subsequently calculated using equation (10), (9), and (8), respectively.

Measured water surface elevation above the flume bottom ($H_0$) for Run 68 at any time instant as shown in FIG. 24*a* is used as an input, along with e, $H_2$, $V_2$, $A_0$, and B to calculate $V_0$, $V_1$, and W at any time instant. For this run, e=2 inches (51 mm), $H_2$=1.25 inches (37 mm), $A_0$=34 inches (length) times 9 inches (width)=306 squared inches (0.20 $m^2$), and B=12 inches (30 cm). For this and any other runs, $V_2$=0. Calculated values of $V_0$, $V_1$, $H_1$, W are shown respectively in FIGS. 28*a*–28*d*. Calculated and measured values of $V_0$ are compared in FIG. 29. The difference between calculated and measured values of $V_0$ is larger at the beginning but gets smaller toward the end. Calculated and measured values W are compared in FIG. 30. Calculated average surge speed (1.94 m/s) is close to measured one (1.73 m/s) with a 12 percent difference.

The one-dimensional steady-state aerodynamic model shown in FIG. 31 was developed to determine the size of the air intake conduit for inside pressure to be almost equal to outside pressure. As illustrated in FIG. 31, air pressure at the water surface inside the flushing tank (flush reservoir) is assumed to be equal to outside atmospheric pressure.

However, in the vacuum flushing tank/chamber, pressure at the water surface may be significantly lower than the outside atmospheric pressure if the size of the air intake conduit is small. The following five equations can be used to solve for the five unknowns in FIG. 31:

Conservation of air flow energy between the outside atmosphere to the air intake:

$$\frac{k}{k+1}\left(\frac{P_n}{\rho_n}-\frac{P_a}{\rho_a}\right)+k_{ent}\frac{V_n^2}{2}+\frac{V_n^2}{2}=0 \tag{12}$$

Assume an adiabatic process in airflow from the outside atmosphere to the air intake:

$$\frac{P_n^{\frac{1}{k}}}{\rho_n}=\frac{P_a^{\frac{1}{k}}}{\rho_a} \tag{13}$$

Conservation of air flow energy between the outside atmosphere and the inside flushing tank:

$$\frac{k}{k-1}\left(\frac{P_0}{\rho_0}+\frac{P_a}{\rho_a}\right)+\frac{\lambda\cdot l}{D}\cdot\frac{V_n^2}{2}+(k_{ent}+k_{exit})\frac{V_n^2}{2}+\frac{V_0^2}{2}=0 \tag{14}$$

Assume an adiabatic process in airflow from the air intake to the air intake:

$$\frac{P_0^{\frac{1}{k}}}{\rho_0}=\frac{P_a^{\frac{1}{k}}}{\rho_a} \tag{15}$$

Conservation of mass between the outside atmosphere and the inside flushing tank:

$$\rho_0\cdot V_0\cdot A_0=\rho_n\cdot V_n\cdot A_n\cdot \tag{16}$$

In the above five equations, k is a thermodynamic constant equal to 1.4, $k_{ent}$ is the local energy loss coefficient at the entrance to the intake pipe, $k_{exit}$ is the local energy loss coefficient at the exit from the intake pipe, λ is the friction factor for the intake pipe, l is the length of the intake pipe, and D is the diameter of the intake pipe.

Using $$C=\frac{\rho_a}{P_a^{\frac{1}{k}}}(const.)$$

equation (13) becomes, $$\rho_n=C\cdot P_n^{\frac{1}{k}} \tag{17}$$

equation (15) becomes, $$\rho_0=C\cdot P_0^{\frac{1}{k}} \tag{18}$$

Substituting equations (17) and (18) into equation (16) yields, $$P_0^{\frac{1}{k}}\cdot V_0\cdot A_0=P_n^{\frac{1}{k}}\cdot V_n\cdot A_n$$

Thus, $$V_n=\frac{P_0^{\frac{1}{k}}\cdot A_0}{P_n^{\frac{1}{k}}\cdot A_n}\cdot V_0 \tag{19}$$

Substituting equations (18) and (19) into equation (14) yields, $$\frac{k}{k+1}\left(\frac{P_0^{\frac{k-1}{k}}}{C}-\frac{P_a}{\rho_a}\right)+\frac{V_0^2}{2}\left(\frac{P_0^{\frac{2}{k}}\cdot A_0^2}{P_n^{\frac{2}{k}}\cdot A_n^2}\right)\left(\frac{\lambda\cdot l}{D}+k_{ent}+k_{exit}\right)+\frac{V_0^2}{2}=0$$

Rearranging the above equation gives $P_n$ as, $$P_n=\left[\frac{V_0^2\left(\frac{\lambda\cdot l}{D}+k_{ent}+k_{exit}\right)P_0^{\frac{2}{k}}\cdot\frac{A_0^2}{A_n^2}}{-\left[\frac{2k}{k-1}\left(\frac{P_0^{\frac{k-1}{k}}}{C}-\frac{P_a}{\rho_a}\right)+V_0^2\right]}\right]^{\frac{k}{2}} \tag{20}$$

Substituting equation (17) and (19) into equation (12) yields, $$\frac{k}{k-1}\left(\frac{P_n^{\frac{k-1}{k}}}{C}-\frac{P_a}{\rho_a}\right)+\frac{V_0^2}{2}\left(\frac{P_0^{\frac{2}{k}}\cdot A_0^2}{P_n^{\frac{2}{k}}\cdot A_n^2}\right)(k_{ent}+1)=0 \tag{21}$$

Substituting equation (20) into equation (21) gives, $$\frac{k}{k-1}\frac{1}{C}\left[\frac{V_0^2\left(\frac{\lambda\cdot l}{D}+k_{ent}+k_{exit}\right)P_0^{\frac{2}{k}}\cdot\frac{A_0^2}{A_n^2}}{-\left[\frac{2k}{k-1}\left(\frac{P_0^{\frac{k-1}{k}}}{C}-\frac{P_a}{\rho_a}\right)+V_0^2\right]}\right]^{\frac{k-1}{2}}-\frac{k}{k-1}\cdot\frac{P_a}{\rho_a}-\frac{k_{ent}+1}{\frac{\lambda\cdot l}{D}+k_{ent}+k_{exit}}\left[\frac{k}{k-1}\left(\frac{P_0^{\frac{k-1}{k}}}{C}-\frac{P_a}{\rho_a}\right)+\frac{V_0^2}{2}\right]=0 \tag{22}$$

The above equation (22) is an implicit relationship between $V_0$ and $P_0$. The value of air pressure inside the flushing tank ($P_0$) can be solved for a given value of downward water flow velocity inside the flushing tank ($V_0$) and values of other parameters. The Goal Seek feature in Microsoft Excel can be used to solve this explicit equation.

In the calculations, values of parameters used are: $k_{ent}$=0.5, $k_{exit}$=1.0, λ0.02, 1 =6 in, $P_a$=101.3 kPa, $\rho_a$=1.225 kg/m$^3$, $A_0$=36 in×9 in=324 in$^2$ (0.21 m$^2$). Three values of diameter of air intake conduit are used, and corresponding calculated air pressures inside the vacuum flushing tank after the valve opens as a percentage of outside air pressure are shown in Table 5.

TABLE 5

Calculated Air Pressure inside Flushing Tank as Percentage of Outside Air Pressure

| $V_0$ (m/s) | $P_0$/Pair (%) with Conduit Diameter (D) = 1 inch (25 mm) | $P_0$/Pair (%) with Conduit Diameter (D) = 2 inches (51 mm) | $P_0$/Pair (%) with Conduit Diameter (D) = 3 inches (76 mm) |
|---|---|---|---|
| 0.38 | 90.5 | 98.1 | 99.88 |
| 0.56 | 80.1 | 95.8 | 99.73 |
| 0.71 | 69.6 | 93.3 | 99.57 |
| 0.85 | 58.7 | 90.6 | 99.39 |
| 1.02 | 45.2 | 86.6 | 99.12 |
| 1.24 | 28.8 | 80.7 | 98.70 |

For Run 68 at the initial time, $H_0$=0.83 m, $V_0$=0.27 m/s. For Run 68 and any other vacuum flushing runs, inner diameter of the air intake conduit is 6 inches (152 mm). Under these conditions, the difference between inside pressure and outside pressure is extremely small (less than 0.12 percent difference according to Table 5). The assumption of equal inside and outside air pressures in the hydrodynamic model is acceptable.

Calculation of Critical Current Velocity for Incipient Motion of Sediment Particles For sediment particles to move/scour, the actual current velocity should be larger than the critical velocity for incipient motion. Chang, H. H. (1988), Fluvial Processes in River Engineering, Krieger Publishing Company, Malabar, Fla.

Given diameter of the individual sediment particles (d), density of the sediment particles ($\rho_s$), density of water ($\rho$), kinematic viscosity of water ($\nu$), and gravitational acceleration (g), critical shields stress for non-cohesive sediment can be found from Shields Diagram.

In this study, $d_{50}$=0.00014 m, $\rho_s$=2,650 kg/m$^3$, $\rho$=1,000 kg/m$^3$, g=9.8 m/s$^2$, $\nu$=1×10$^{-6}$ m$^2$/s.

Therefore, $$\frac{d}{\nu}\sqrt{0.1\left(\frac{\rho_s}{\rho}-1\right)gd} = \frac{0.00014\text{ m}}{1\times10^{-6}\text{ m}^2/\text{s}}\sqrt{0.1\left(\frac{2.65}{1}-1\right)9.8\text{ m/s}^2\times0.00014\text{ m}} = 2.11 \quad (23)$$

Using the above value in the Shields Diagram, the critical shields stress ($\tau^*_c$) is found to be 0.07.

From definition of the Shields stress ($\tau^*$), $$\tau_* = \frac{\tau}{(\rho_s-\rho)gd} \quad (24)$$

we can find the critical shear stress ($\tau_c$) as:

$$\tau_c=0.07(2{,}650-1{,}000)\text{kg}/m^3 9.8\ m/s^2\times0.00014\ m=0.158\ Pa$$

From definition of the shear velocity ($V^*$), $$V_* = \sqrt{\frac{\tau}{\rho}} \quad (25)$$

we can find the critical shear velocity ($V^*_c$) as:

$$V^*_c=0.0126\ m/s$$

The critical current velocity ($V_c$) is related to the critical shear velocity in the way depending on type of the flow. To decide type of the flow, Reynolds number ($R_e$) and Roughness Reynolds number ($R_e^*$) are needed. Reynolds number ($R_e$) is defined as:

$$R_e = \frac{4\times V\times R_h}{\nu} \quad (26)$$

where V is the cross-sectionally averaged current velocity and $R_h$ is the hydraulic radius. For rectangular channel the hydraulic radius ($R_h$) can be calculated as follows:

$$R_h = \frac{B\times H}{B+2H} \quad (27)$$

where H is the water depth, and B is the channel width.

If Reynolds number (Re) is >2,100, the flow is turbulent (Street, R. L., G. Z. Watters, and J. K. Vennard (1996), *Elementary Fluid Mechanics*, 7$^{th}$ Edition, John Wiley & Son, New York, N.Y.). In this study, B is 0.305 m. H is from 0.100 to 0.457 m (height of the flume). V should be in the range from 0.2 to 2.19 m/s. Thus, Re is from 80,000 to 100,000, and the flow is turbulent.

If the flow is turbulent, the Roughness Reynolds number ($R_e^*$) can be used to decide whether the flow is turbulent smooth, turbulent transitional or turbulent rough. The Roughness Reynolds number ($R_e^*$) is defined as follows:

$$R_{e^*} = \frac{V_*\times\Delta}{\nu} \quad (28)$$

where $V^*$ is shear velocity. In this case we use $V^*_c$ for $V^*$. $\Delta$ is the size of roughness and is set equal to $d_{50}$ in this study, $$\Delta=d_{50}. \ldots 29$$

If $R_e^*$<3.5, the flow is turbulent smooth. If $R_e^*$>70, the flow is turbulent rough. Otherwise, the flow is turbulent transitional. In this study, $V^*=V^*_c$=0.0126 m/s as calculated above, $\Delta=d_{50}$=0.14 mm, $\nu$=1.0E-6, consequently, Re*= 1.76<3.5. This means the flow is turbulent smooth.

For turbulent smooth flow, relationship between current velocity and shear velocity is:

$$V = V_*\left(5.75\log\frac{R_h V_*}{\nu}+1.75\right) \quad (30)$$

Substituting the critical shear velocity into the equation above, we obtain the critical current velocity:

$$V_c = 0.0216\text{ m/s}\left(5.75\log\frac{R_h 0.0126}{1\times10^{-6}}+1.75\right) \quad (31)$$

For Run 68 at the initial time, $H_0$=0.83 m, $H_1$=0.13 m, $V_1$=1.36 m/s. From equation 27, $R_h$ is calculated as 0.07 m.

From equation 31, $V_c$ is calculated as 0.26 m/s. The calculated flow velocity in the flume ($V_1$=1.36 m/s) is much larger than the calculated critical flow velocity ($V_c$=0.26 m/s). Therefore, sediments on the flume bed can be moved by the flushing surge.

Calculation of amount of sediments flushed

The amount of noncohesive sediments transported through a cross section per unit time can be calculated by using one of the many methods available in literature (Chang, 1988). Acker and White's method, one of the prominent methods, is described below:

$$\left(\frac{U_*}{U}\right)^{C_1}\frac{\rho\cdot\overline{C}R_h}{\rho_s\cdot d}=C_2\left(\frac{F_1}{C_3}-1\right)^{C_4}\quad\text{where }\overline{C}=\frac{Q_s}{Q} \tag{32}$$

$$F_1=\left[\frac{U_*^{C_1}}{\sqrt{Rgd}}\right]\left[\frac{U}{\sqrt{32}\ \log(10\,R_h/d)}\right]^{1-C_1} \tag{33}$$

Constants $C_1$, $C_2$, $C_3$, and $C_4$ are calculated as follow:

$$d_*=\left(\frac{Rg}{\nu^2}\right)^{1/3}d$$

If $1.0<d^*\leqq 60.0$, $C_1$=1.0−0.56 log d.

log $C_2$=2.86 log d−(log d.)$^2$−3.53

$$C_3=\frac{0.23}{d_*^{1/2}}+0.14$$

$$C_4=\frac{9.66}{d_*}+1.34$$

If d>60.0, $C_1$=0, $C_2$=0.025, $C_3$=0.17, and $C_4$=1.50.

In the above equations, Qs is the volumetric sediment transport rate ($m^3$/s), Q is the volumetric water flowrate ($m^3$/s) and R is the relative density difference $(\rho_s-\rho)/\rho$.

Figure 32:
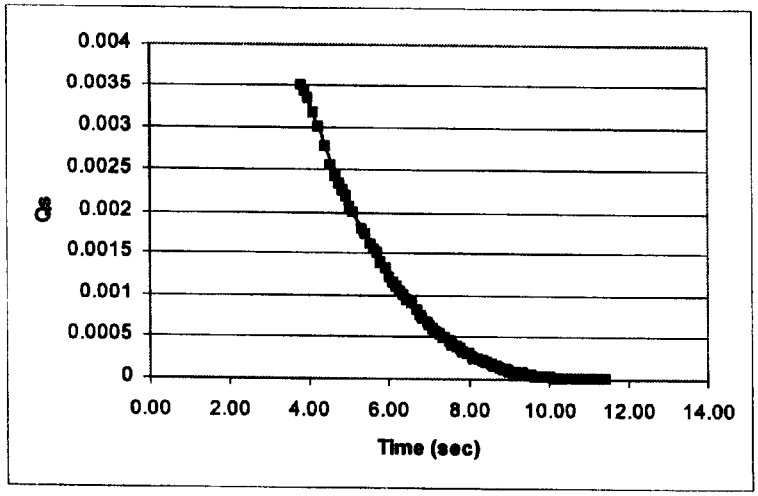
FIG. 32 is a graph, illustrating the variation of Sediment Transport Rate (Qs, $m^3/s$) calculated from the one dimensional steady state hydrodynamic model of FIG. 27 for Test Run 68 and Acker&White's Sediment Transport Formula and parameters.

For Run 68, calculated sediment transport rate at any time using Acker and White's method is shown in FIG. 32.

Figure 33:
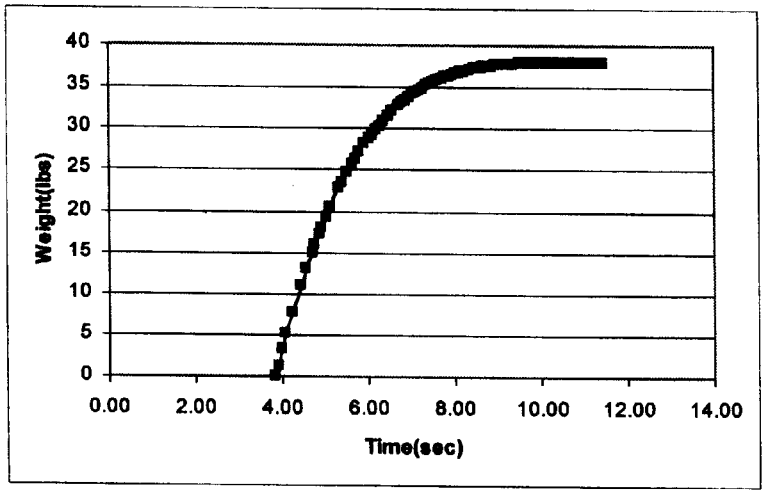
FIG. 33 is a graph, illustrating the Cumulative Sediment Transport Amount (weight, lbs) calculated from the Model of FIG. 27 based on Acker&White's Sediment Transport Formula and parameters for laboratory Test Run 68.

Due to difficulty in measuring sediment transport at any time instant, only total amount of sediments that was flushed across end of the flume and over the entire flushing process was measured. Calculated cumulative/integrated amount of flushed sediments over the time is shown in FIG. 33. By the time the surge reached the end of the flume at 5.4 seconds (flushing began at 3.83 seconds), calculated integrated amount of flushed sediments is 23.4 pounds, which is very close to the measured amount of 25.2 pounds with an 8 percent difference.

From the foregoing, it is to be appreciated that the invention operates under atmospheric pressure and a hydrostatic head that builds up in the flush reservoir to a level that suddenly breaks the vacuum. It is an automatic-hydraulically-balanced flushing device requiring no mechanical moving parts and no complex control instrumentation. There is also no extramural source of flushing water needed because liquid in the flush reservoir is the same as the liquid in the storage tank, or in the sewer, during the storm. The novel flushing system substantially reduces sewer solid deposition and accumulation and thus optimizes performance of sewage systems, maintains their structural integrity and substantially minimizes pollution of receiving waters.

Although a particular embodiment of the invention has been described in detail for purposes of illustration, various modifications may be made without departing from the spirit and scope of the invention. Accordingly, the invention is not to be limited, except as by the appended claims.

I claim:

1. A flushing system for substantially reducing sewer solid accumulation in an urban drainage system, comprising:

at least one flush reservoir having an ingress and egress port in fluid communication with the urban drainage system for receiving and discharging wet weather flow;

an air intake conduit for providing air into the at least one flush reservoir; and an air release check valve for the at least one flush reservoir that closes when the at least one flush reservoir is substantially full of wet weather flow to create a vacuum on draining of the urban drainage system, the vacuum broken by the intake of air when the urban drainage system is drained to a predetermined level thereby discharging the wet weather flow in a surge from the at least one flush reservoir to flush accumulated sewer solids from the urban drainage system.

2. The flushing system of claim 1, wherein the urban drainage system comprises one of at least one sewer line and at least one storage tank for one or more of combined sewer overflow, separated sanitary sewer overflow, and stormwater overflow, the at least one flush reservoir at an upstream end of a segment of the at least one sewer line and of the at least one storage tank.

3. The flushing system of claim 2, wherein the sewer line includes a sewer line flush chamber for receipt of the at least one flush reservoir in the sewer line, the floor of the sewer line flush chamber and the at least one storage tank coextensive with the floor of the at least one flush reservoir.

4. The flushing system of claim 1, wherein the velocity of the surge is at least about 2 m/s.

5. The flushing system of claim 1, wherein the ingress and egress port is along a bottom edge of a downstream sidewall of the at least one flush reservoir.

6. The flushing system of claim 1, wherein the height of the ingress and egress port is about two to about four inches above the historical height of the sewer solid layer immediately downstream of the at least one flush reservoir.

7. The flushing system of claim 5, wherein the air intake conduit connects from a first upper opening at the top of the at least one flush reservoir and extends along another sidewall to a lower opening about two to about three inches higher than the top of the ingress and egress port, the at least one flush reservoir discharging the wet weather flow when the urban drainage system drains below the lower opening of the air intake conduit.

8. The flushing system of claim 1, wherein the size of the air intake conduit opening comprises about thirty percent of the size of the ingress and egress port.

9. The flushing system of claim 2, wherein the volume of the at least one flush reservoir comprises about 10–20 percent of the volume of the at least one storage tank and about 20–50 percent of the volume of the total length of sewer line to be flushed.

10. The flushing system of claim 2, wherein there is at least one flush reservoir installed per 500–1000 feet of sewer line.

11. The flushing system of claim 2, wherein the at least one sewer line further receives and discharges dry weather flow.

12. A flush reservoir, comprising:

a receptacle having a top and sidewalls and an ingress and egress port through at least one of the sidewalls;

an air intake conduit connected through another of the sidewalls of the receptacle; and an air release check valve connected to the flush reservoir.

13. The flush reservoir of claim 12, wherein the ingress and egress port is through a bottom edge of the at least one of the sidewalls.

14. The flush reservoir of claim 12, wherein the height of the ingress and egress port is about two to about four inches above the historical height of the accumulated sewer solid layer in a sewer line and a storage tank where the flush reservoir is to be installed.

15. The flush reservoir of claim 12, wherein the air release check valve is mounted in the top of the receptacle.

16. The flush reservoir of claim 12, wherein the air intake conduit is selected from the group comprised of a rectangular duct defined by a partitioning wall and an air intake tube.

17. The flush reservoir of claim 16, wherein the air intake conduit connects from an upper opening at the top of the flush reservoir and extends to a lower opening along a sidewall other than the sidewall with the ingress and egress port.

18. The flush reservoir of claim 17, wherein the size of the air intake conduit opening is about thirty percent of the size of the ingress and egress port.

19. A method for substantially reducing sewer solid accumulation in an urban drainage system, comprising the steps of:

providing at least one flush reservoir in an upstream portion of the urban drainage system, the at least one flush reservoir having an ingress and egress port in fluid communication with the urban drainage system and an air release valve that closes when the at least one flush reservoir is substantially full of wet weather flow to create a vacuum therein;

providing air to the at least one flush reservoir; and draining the urban drainage system to a level to permit the intake of air that breaks the vacuum causing the wet weather flow to surge out the ingress and egress port to flush accumulated sewer solids from the urban drainage system.

20. The method of claim 19, wherein the urban drainage system comprises one of at least one sewer line and at least one storage tank for one or more of combined sewer overflow, separated sanitary sewer overflow, and stormwater overflow, the at least one flush reservoir at an upstream end of a segment of the at least one sewer line and of the at least one storage tank.

21. The method of claim 20, wherein the sewer line includes a sewer line flush chamber for receipt of the at least one flush reservoir.

* * * * *